United States Patent [19]

Lorence et al.

[11] Patent Number: 5,019,681

[45] Date of Patent: May 28, 1991

[54] REFLECTIVE TEMPERATURE COMPENSATING MICROWAVE SUSCEPTORS

[75] Inventors: Matthew W. Lorence, Lakeville; Michael J. Rice, St. Paul; Ronald R. Lentz, Plymouth; Peter S. Pesheck, Brooklyn Center; Michael R. Perry, Plymouth, all of Minn.

[73] Assignee: The Pillsbury Company, Minneapolis, Minn.

[21] Appl. No.: 480,071

[22] Filed: Feb. 14, 1990

[51] Int. Cl.[5] ..... H05B 6/80

[52] U.S. Cl. ..... 219/10.55 F; 219/10.55 E; 426/107; 426/234; 426/243; 99/DIG. 14

[58] Field of Search ..... 29/10.55 E, 10.55 F, 29/10.55 R, 10.55 M; 426/107, 234, 241, 243; 99/DIG. 14; 126/390

[56] References Cited

U.S. PATENT DOCUMENTS

| | | | |
|---|---|---|---|
| 2,856,497 | 10/1958 | Rudenberg | 219/10.55 E |
| 3,941,967 | 3/1976 | Sumi et al. | 219/10.55 E |
| 4,190,757 | 2/1980 | Turpin et al. | 219/10.55 E |
| 4,266,108 | 5/1981 | Anderson et al. | 219/10.55 E |
| 4,808,780 | 2/1989 | Seaborne | 219/10.55 F |
| 4,927,991 | 5/1990 | Wendt et al. | 426/107 |

*Primary Examiner*—Philip H. Leung

*Attorney, Agent, or Firm*—Arnold, White & Durkee

[57] ABSTRACT

A reflective temperature compensating microwave susceptor is disclosed. The susceptor has a microwave interactive heating layer which may be characterized in various ways. In one aspect, the microwave interactive heating layer is operable to provide an increase in reflectance by several factors during heating from 23° C. to 250° C. The microwave interactive heating layer may have a surface resistance that decreases significantly from 23° C. to 250° C. In another aspect, the microwave interactive heating layer may have an electrical conductivity which increases significantly from 23° to 250° C. The microwave interactive heating layer is preferably formed as a thin film deposited upon a substrate, preferably a sheet of polyester. The coated polyester is adhesively bonded to a support member. The microwave interactive heating layer preferably comprises $TiO_x$, where x has a value between two and one. Most preferably, the microwave interactive heating layer predominantly comprises $Ti_2O_3$.

25 Claims, 12 Drawing Sheets

FIG.3
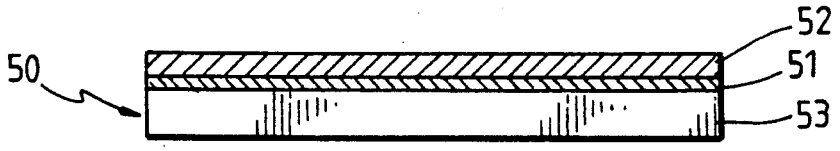
FIG.4
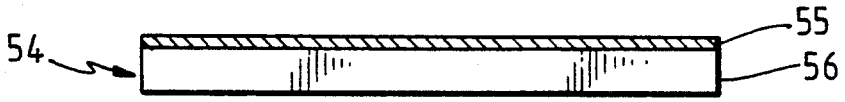
FIG.5
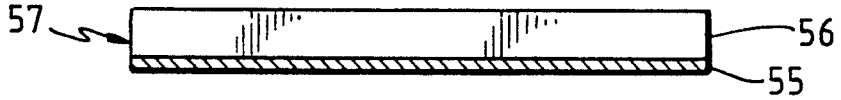
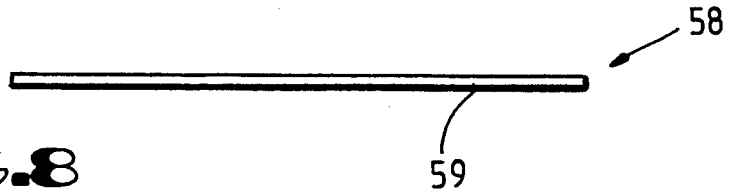
FIG.8

FIG.7A
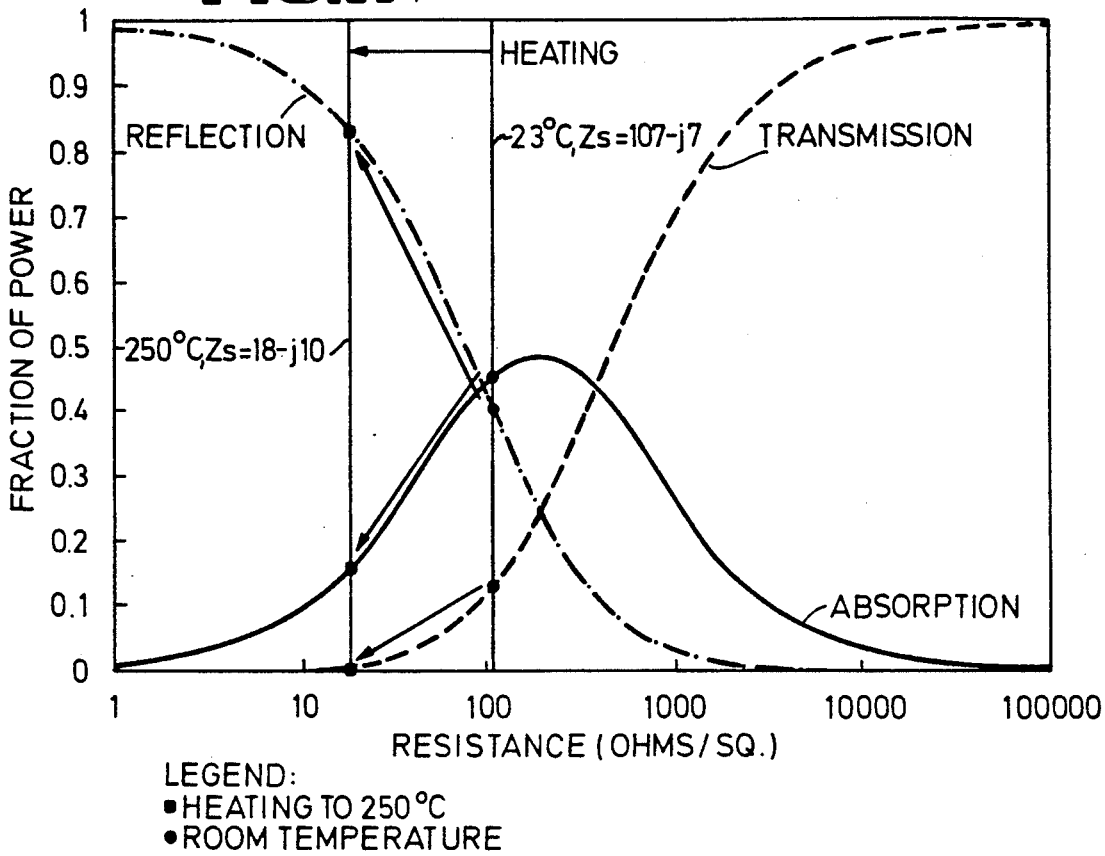
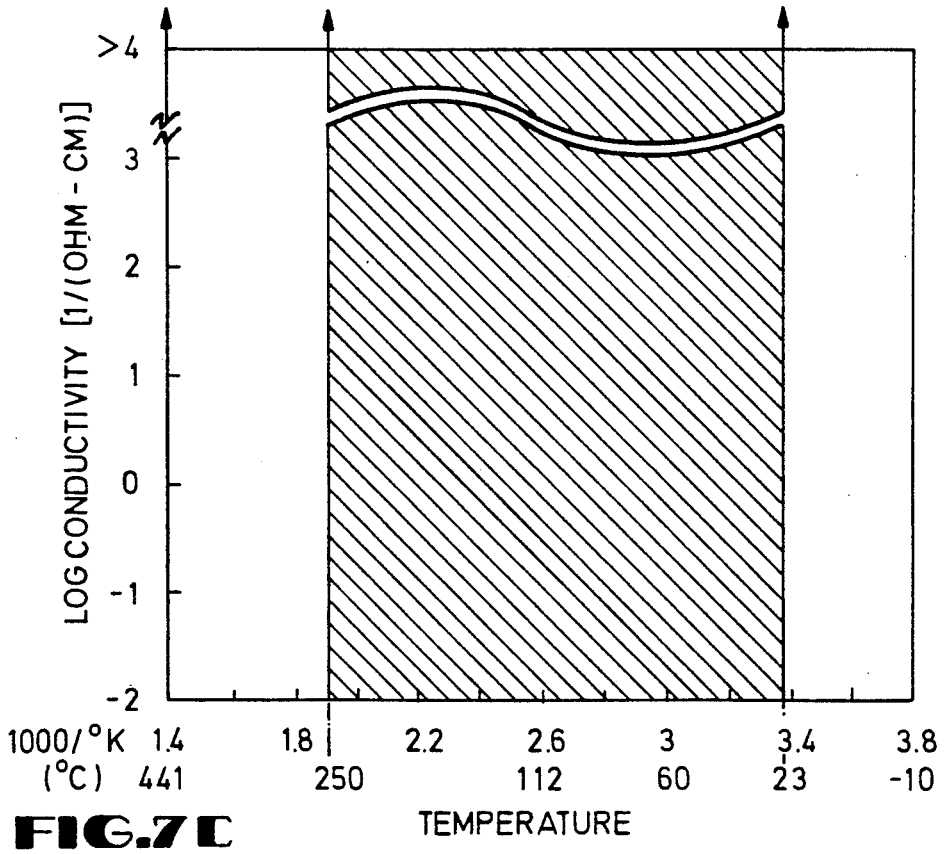
FIG.7C

FIG.17
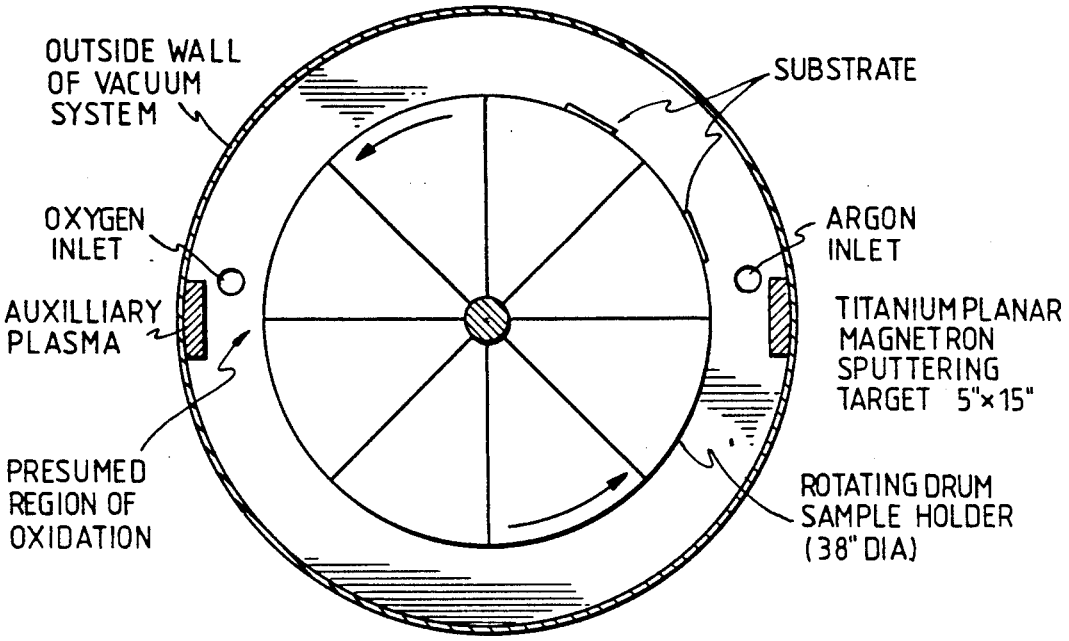
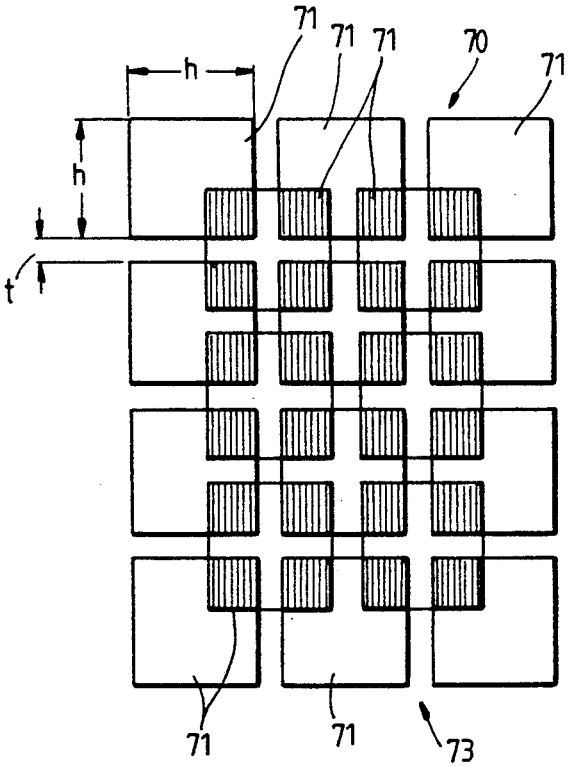
FIG.18A
FIG.18B
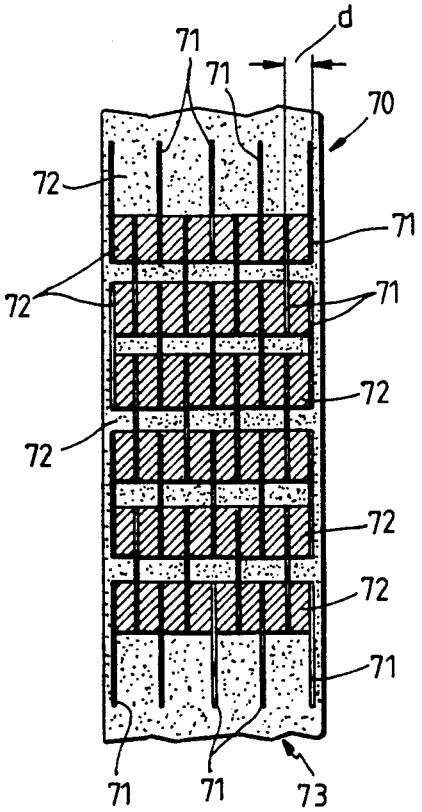

REFLECTIVE TEMPERATURE COMPENSATING MICROWAVE SUSCEPTORS

BACKGROUND OF THE DISCLOSURE

Microwave heating of foods in a microwave oven differs significantly from conventional heating in a conventional oven. Conventional heating involves surface heating of the food by energy transfer from a hot oven atmosphere. In contrast, microwave heating involves the absorption of microwaves which may penetrate significantly below the surface of the food. In a microwave oven, the oven atmosphere will be at a relatively low temperature. Therefore, surface heating of foods in a microwave oven can be problematical.

A susceptor is a microwave responsive heating device that is used in a microwave oven for purposes such as crispening the surface of a food product or for browning. When the susceptor is exposed to microwave energy, the susceptor gets hot, and in turn heats the surface of the food product.

Conventional susceptors have a thin layer of polyester, used as a substrate, upon which is deposited a thin metal film. For example, U.S. Pat. No. 4,641,005, issued to Seiferth, discloses a conventional metallized polyester film-type susceptor which is bonded to a sheet of paper. Herein, the word "substrate" is used to refer to the material on which the metal layer is directly deposited, e.g., during vacuum evaporation, sputtering, or the like. A biaxially oriented polyester film is the substrate used in typical conventional susceptors.

In order to provide some stability to the shape of the susceptor, the metallized layer of polyester is typically bonded to a support member, such as a sheet of paper or paperboard. Usually, the thin film of metal is positioned at the adhesive interface between the layer of polyester and the sheet of paper.

Conventional metallized polyester film cannot, however, be heated by itself or with many food items in a microwave oven without undergoing severe structural changes: the polyester film, initially in a flat sheet, may soften, shrivel, shrink, and eventually may melt during microwave heating. Typical polyester melts at approximately 220°-260° C.

During heating, it has been observed that conventional metallized polyester susceptors will tend to break up during heating, even when the metallized polyester is adhesively bonded to a sheet of paper. Such breakup of the metallized polyester layer reduces the responsiveness of the susceptor to microwave heating. A conventional thin film susceptor becomes more transmissive and less reflective to microwave radiation during heating, as a result of breakup. A conventional thin film susceptor will typically exhibit less absorption to microwave radiation after heating. The responsiveness of the conventional susceptor to microwave radiation decreases significantly as a result of breakup.

Conventional susceptors undergo non-reversible structural and electrical changes when they are used in a microwave oven. The reduction in the microwave absorbance of the susceptor, and the consequent diminished ability of the susceptor to heat the food, is irreversible. Because breakup causes the susceptor to become more microwave transparent, it typically results in an undesirable degree of dielectric heating of the food which may, for example, lead to toughening of breadstuffs and meat.

There has been a long felt need to overcome the deleterious effects of susceptor breakup, which may adversely affect the food to be browned, crispened or otherwise heated in the presence of a microwave susceptor. There has also been a need for a susceptor which becomes substantially more microwave reflective at elevated cooking temperatures. There has been a further need for a susceptor which undergoes self-limiting microwave absorption at elevated cooking temperatures to provide a temperature controlled, thermostated crisping surface, but which remains highly reflective to microwave radiation.

Various attempts have been made in the past to provide microwave absorbing materials having a maximum temperature limit which can be attained when the material is subjected to microwave radiation. Early attempts relied upon the Curie effect, and used ferromagnetic materials for heating in response to the magnetic component of the microwave energy field.

The Curie effect may be generally described as follows. Certain microwave absorbing materials, specifically ferrites, have a Curie temperature, which theoretically provides an upper temperature limit that can be attained when the magnetic component of microwave radiation is used for heating. When the Curie temperature is reached, the ferrite material stops heating in response to the magnetic component of the microwave field, because the magnetic loss factor $\mu''$ (the imaginary part of the complex magnetic permeability) essentially goes to zero. Prior attempts to use the Curie effect for temperature limited heating applications have generally sought to minimize the heating effects of the electric component of the microwave field. A material which exhibits the Curie effect may, however, continue to heat above the Curie temperature if the electric loss factor $\epsilon''$ is significant and the local electric field is appreciable.

An early example of an attempt to use the Curie effect is shown by U.S. Pat. No. 2,830,162, issued to Copson et al. However, Copson et al. teach that the material being heated to its Curie temperature becomes more transmissive—"any further R. F. energy thereafter received being transmitted as R. F. energy without significant loss." See column 1, lines 57-60 (emphasis added). Thus, Copson et al. fail to disclose a microwave susceptor which becomes substantially more reflective at elevated cooking temperatures.

An effort to achieve a self-limiting temperature is shown in U.S. Pat. No. 4,266,108, issued to Anderson et al. The Anderson et al. reference discloses a microwave absorption material which uses the magnetic component of the microwave energy for heating instead of the electrical component of the microwave energy. The Anderson et al. reference describes as a "problem": how to provide a device which would utilize the magnetic field component of the microwave energy as a source of energy for heating, while substantially excluding the electrical field component from providing energy for heating, in order to prevent thermal runaway. See column 4, lines 29-34.

The solution proposed by Anderson et al. involved placing a metallic electrically conductive surface, such as a sheet of metal, immediately next to the microwave absorbing material. At such a conducting surface, the magnetic component of the microwave field is maximum while the electric field component is at a node, or is minimal. As taught by Anderson et al., "little or no energy is available to the absorbing material from the electric field component." See column 4, lines 40-68.

Anderson et al. also taught the use of materials which did not change electrical resistivity with temperature. For example, see the table at column 5, beginning at line 23. The value for $\epsilon''$ was 0.76 at room temperature, and was 0.76 above 255° C. $\epsilon''$ can be converted to a value of conductivity, or alternatively to a value of resistivity. From the value given for $\epsilon''$ in the table disclosed by Anderson et al., it can be seen that the resistivity did not change with temperature. The total susceptor structure disclosed by Anderson et al. had a transmittance of zero, because the metallic reflective surface did not permit microwave radiation to be transmitted through the composite structure.

Efforts to use the Curie effect and heating based upon the magnetic component of the microwave field have been limited by the fact that the magnetic loss factor $\mu''$ of practical materials is of a relatively small magnitude. A much larger magnitude of the electric loss factor $\epsilon''$ is available in practical materials, and in accordance with the present invention can be used to provide much more effective temperature dependent heating control than prior Curie effect approaches. In addition, because the magnetic loss factor $\mu''$ is small, practical devices require thick layers of material to achieve significant microwave absorption and these magnetic devices, therefore, tend to be expensive.

Similarly, U.S. Pat. No. 4,190,757, issued to Turpin et al., shows the use of Curie temperature with ferromagnetic materials as the microwave absorbing material.

Turpin et al. state that any suitable lossy substance that will heat in bulk to more than 212° F. may be used as the active heating ingredient of the microwave energy absorbent layer 46. They then provide a list of suggested substances, which includes: dielectric materials such as asbestos, some fire brick, carbon and graphite; and period eight oxides and other oxides such as chromium oxide, cobalt oxide, manganese oxide, samarium oxide, nickel oxide, etc.; and ferromagnetic materials such as powdered iron, some iron oxides, and ferrites including barium ferrite, zinc ferrite, magnesium ferrite, copper ferrite, or any of the other commonly used ferrites and other suitable ferromagnetic materials and alloys such as alloys of manganese, tin and copper or manganese, aluminum and copper and alloys of iron and sulfur, such as pyrrhotite with hexagonal crystals, etc., silicon carbide, iron carbide, strontium ferrite and the like; and, what are loosely referred to as "semiconductors", examples of which are given as zinc oxide, germanium oxide, and barium titanate.

Turpin et al. fail to teach or suggest a susceptor which is transmissive, and which becomes substantially more microwave reflective at elevated temperatures. Turpin et al. use a metal sheet as a support layer 44 for the food product in the claimed preferred embodiment. In such an example, the composite structure would have virtually no transmission of microwave energy. The layer 44 is also suggested as alternatively comprising a nonmetal mineral or a thin glaze of ceramic fused to the upper surface of the heat absorbing layer 46. In this example, the composite structure would not become more reflective as the result of microwave heating.

U.S. Pat. No. 4,808,780, issued to Seaborne, discloses compositions for a ceramic utensil to be used in microwave heating of food items. The compositions include certain metal salts as time and temperature profile moderators in addition to microwave absorbing material and a binder. Certain metal salts are used to dampen or lower the final temperatures reached upon microwave heating of the ceramic composition. Other metal salts are used to increase or accelerate the final temperature reached upon microwave heating. The accelerators are divided into two groups, some of the accelerators being identified as super accelerators which exhibit a markedly greater acceleration effect. Seaborne then goes on to give a list of materials which he states are useful in this particular limited application.

Seaborne states that exemplary useful dampeners are selected from the group consisting of MgO, CaO, $B_2O_3$, Group IA alkali metal (Li, Na, K, Cs, etc.) compounds of chlorates ($LiClO_3$, etc.), metaborates ($LiBO_2$, etc.), bromides (LiBr, etc.), benzoates ($LiCO_2C_6H_5$, etc.), dichromates ($Li_2Cr_2O_7$, etc.), all calcium salts, $SbCl_3$, $NH_4Cl$, $CuCl_2$, $CuSo_4$, $MgCl_2$, $ZnSO_4$, Sn(II) chloride, vanadyl sulfate, chromium chloride, cesium chloride, cobalt chloride, nickel ammonium chloride, $TiO_2$ (rutile and anatase), and mixtures thereof. Seaborne says that exemplary useful accelerators are selected from the group consisting of Group 1A alkali metals (Li, Na, K, Cs, etc.) compounds of chlorides (LiCl, etc.), nitrites ($LiNO_2$, etc.), nitrates ($LiNO_2$, etc.), iodides (LiI, etc.), bromates ($LiBrO_3$, etc.), fluorides (LiF, etc.), carbonates (LiI, etc.), phosphates ($Li_3PO_4$, etc.), sulfites ($LiSO_3$, etc.), sulfides (LiS, etc.), hypophosphites ($LiH_2PO_2$, etc.), $BaCl_2$, $FeCl_3$, sodium borate, magnesium sulfate, $SrCl_2$, $NH_4OH$, Sn(IV) chloride, silver nitrate, TiO, $Ti_2O_3$, silver citratre and mixtures thereof. Seaborne further states that "super accelerators" are selected from the group consisting of $B_4C$, $ReO_3$ CuCl, ferrous ammonium sulfate, $AgNO_3$, Group 1A alkali metals (Li, Na, K, Cs, etc.), compounds of hydroxides (LiOH, etc.), hypochlorites (LiOCl, etc.), hypophosphates ($Li_2H_2P_2O_6$, $Na_4P_2O_6$, etc.), bicarbonates ($LiHCO_3$, etc.), acetates ($LiC_2H_3O_2$, etc.), oxalates ($Li_2C_2O_4$, etc.), citrates ($Li_3C_6H_5O_7$, etc.), chromates ($Li_2CrO_4$,e tc.), and sulfates ($Li_2SO_4$,e tc.), and mixtures thereof. Other exemplary useful accelerators listed by Seaborne are certain highly ionic metal salts of sodium, magnesium, silver, barium, potassium, copper, and titanium, including, for example, NaCl, $NaSO_4$, $AgNO_3$, $NaHCO_3$, $KHCO_3$, $MgSO_4$, sodium citrate, potassium acetate, $BaCl_2$, KI, $KBrO_3$, and CuCl. The most preferred accelerator identified by Seaborne is common salt due to its low cost and availability. See column 7, line 55 to column 8, line 23.

Seaborne failed to discover that certain materials can be used to make a susceptor which becomes substantially more microwave reflective at elevated cooking temperatures, and which have a microwave interactive heating layer whose conductivity increases with increasing temperature.

In the description contained herein, the term "semiconductor" is used to refer to material which is commonly known as semiconductor material, such as silicon and germanium. Semiconductors are a class of materials exhibiting electrical conductivities intermediate between metals and insulators. These intermediate conductivity materials are characterized by the great sensitivity of their electrical conductivities to sample purity, crystal perfection, and external parameters such as temperature, pressure, and frequency of the applied electric field. For example, the addition of less than 0.01% of a particular type of impurity can increase the electrical conductivity of a typical semiconductor like silicon and germanium by six or seven orders of magnitude. In contrast, the addition of impurities to typical metals and semimetals tends to decrease the electrical conductivity, but this decrease is usually small. Furthermore, the conductivity of semiconductors characteristically increases, sometimes by many orders of magnitude, as the temperature is increased. On the other hand, the conductivity of metals and semimetals characteristically decreases when the temperature is increased, and the relative magnitude of this decrease is much smaller than are the characteristic changes for semiconductors. See the *Encyclopedia of Physics*, (2d ed. 1974), edited by Robert M. Besancon and published by Van Nostrand Reinhold Company, pages 835–42 of which are incorporated herein by reference.

In some prior patent descriptions, the term "semiconductive" has been given a different meaning. In some published patent descriptions, thin metal films have been referred to as "semiconductive" in an attempt to describe the fact that the thin film had a measurable surface resistance and would heat when exposed to microwave radiation. An example of this is shown in U.S. Pat. No. 4,267,420, issued to Brastad, where it is said "for the lack of a completely definitive generic word in the broader claims, the term 'semiconducting' will be used." See column 5, lines 28–30. See also U.S. Pat. No. 4,735,513, issued to Watkins et al., at column 5, lines 36–45; U.S. Pat. No. 4,825,025, issued to Seiferth, at column 1, lines 37–37; U.S. Pat. No. 4,230,924, issued to Brastad et al., at column 6, lines 24–28; U.S. Pat. No. 4,777,053, issued to Tobelmann. Thin films of metals such as aluminum, chromium, silver, gold, etc., are not intended to be included in the meaning of the term "semiconductor" as used herein. In the description below of the present invention, the term "semiconductor" is used in accordance with its traditionally accepted meaning to refer to semiconductors like germanium and silicon. The present invention is particularly concerned with semiconductors whose conductivity increases with temperature.

U.S. Pat. No. 4,283,427, to Winters et al., discloses a lossy chemical susceptor which, upon continued exposure to microwave radiation, eventually becomes substantially microwave transparent. Other patents uncovered during a prior art search which provide a general background of the prior art are U.S. Pat. Nos. 4,691,186, to Shin et al., 4,518,651, to Wolfe, Jr., 4,236,055, to Kaminaka, and 3,853,612, to Spanoudis.

It is clear from the above description that conventional susceptors have exhibited problems and drawbacks, and have not been fully satisfactory for all applications and purposes. The need for a susceptor operative to brown and crispen the surface of food, but which does not exhibit the deleterious effects of breakup, and which becomes substantially more microwave reflective and less absorptive at elevated cooking temperatures, is apparent.

BRIEF DESCRIPTION OF THE DRAWINGS

FIG. 3 is a cross-sectional view of a preferred embodiment of a susceptor constructed in accordance with the present invention.

FIG. 4 is a cross-sectional view of an alternative embodiment of a susceptor constructed in accordance with the present invention.

FIG. 5 is a cross-sectional view of an alternative embodiment of a susceptor constructed in accordance with the present invention.

FIG. 7A is a graph showing changes in reflection, absorption and transmission as a function of temperature for a titanium sesquioxide susceptor constructed in accordance with the present invention.

FIG. 7C is a graph similar to FIG. 7B showing an enlargement of a region of particular interest.

FIG. 8 is a cross-sectional view of an alternative embodiment of a susceptor constructed in accordance with the present invention comprising a semiconductor wafer.

FIG. 17 is a partially cut-away plan view of a sputtering apparatus useful in manufacturing a susceptor in accordance with the present invention.

DETAILED DESCRIPTION OF A PREFERRED EMBODIMENT

The ability of a susceptor to brown or crispen food is largely determined by the complex surface impedance of the susceptor and by changes in the surface impedance during cooking. Most microwave ovens operate at a microwave frequency of 2.45 GHz. The surface impedance of the susceptor can be measured at the frequency of the microwave oven, e.g., 2.45 GHz, with a network analyzer.

The effect of susceptor breakup on surface impedance can be seen in Table 1, which shows surface impedances for conventional susceptors, measured with a network analyzer before and after microwaving each product according to package directions. The data in Table 1 show that the dominant electrical effect of breakup is a large increase in the imaginary part of the surface impedance with a concomitant dramatic decrease in susceptor absorption and reflection, and increased microwave transmission. While not intending to be bound by any particular theory, microscopic examination of conventional aluminized polyethylene terephthalate (PET) susceptors before and after cooking in the microwave shows that the observed electrical changes correlate with the appearance of microscopic and macroscopic cracks and other discontinuities in the conductive, microwave interactive layer of the susceptor.

TABLE 1

| Product | Surface Impedance ohms/square | % R | % T | % A |
|---|---|---|---|---|
| Totino's Microwave Pizza | | | | |
| Before MW | 73.4 - j7.8 | 51.7 | 7.9 | 40.3 |
| After MW | 160.6 - j1101.6 | 2.7 | 92.8 | 4.5 |
| Van de Kamp's Microwave Fish Fillets | | | | |
| #1: | | | | |
| Before MW | 84.0 - j5.5 | 47.8 | 9.6 | 42.6 |
| After MW | 163.0 - j602.9 | 7.3 | 80.1 | 12.6 |
| #2: | | | | |
| Before MW | 126.2 - j13.3 | 35.8 | 16.2 | 48.0 |
| After MW | 163.3 - j596.3 | 7.4 | 79.7 | 12.8 |

Highly significant in the above observations of the heating effects on a conventional susceptor is the substantial decrease in reflection (R) as a result of heating. The transmission (T) increased dramatically as a result of heating. The absorption (A) decreased significantly. In Table 1, the reflection (R), transmission (T) and absorption (A) are expressed in percent.

Figure 1:
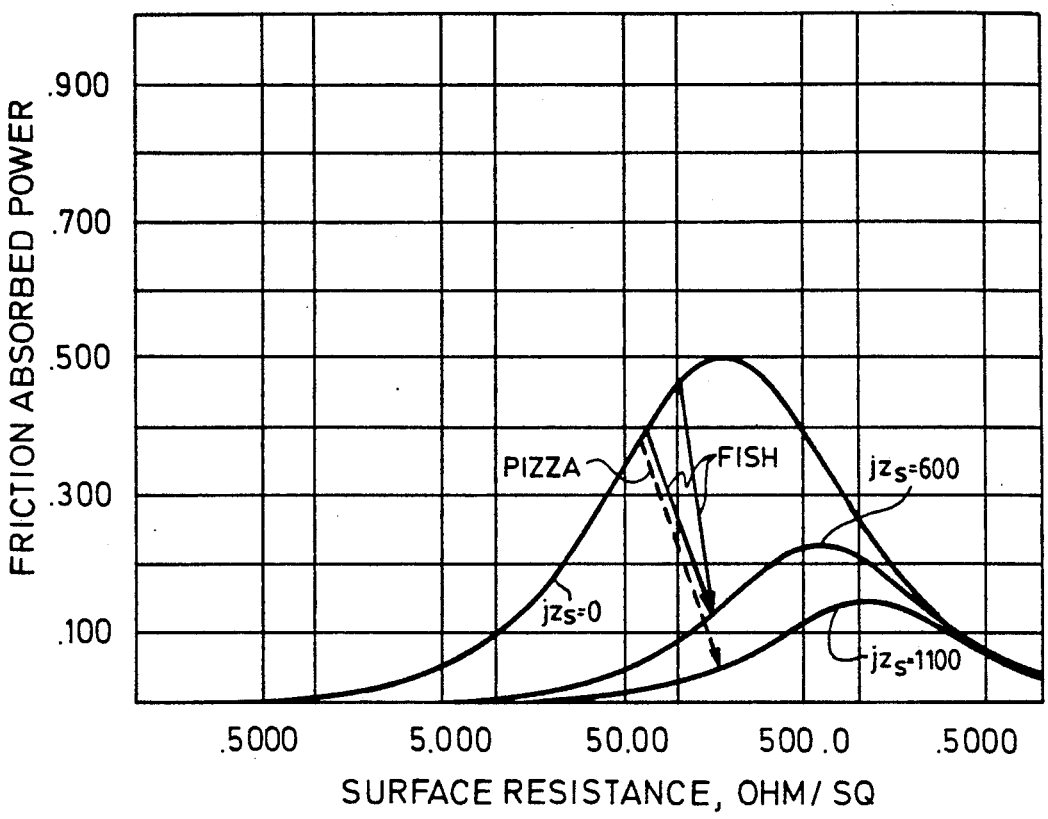
FIG. 1 is a graph showing the fraction of microwave energy which is absorbed versus surface resistance for two examples of susceptors shown before and after heating food products.
Figure 2:
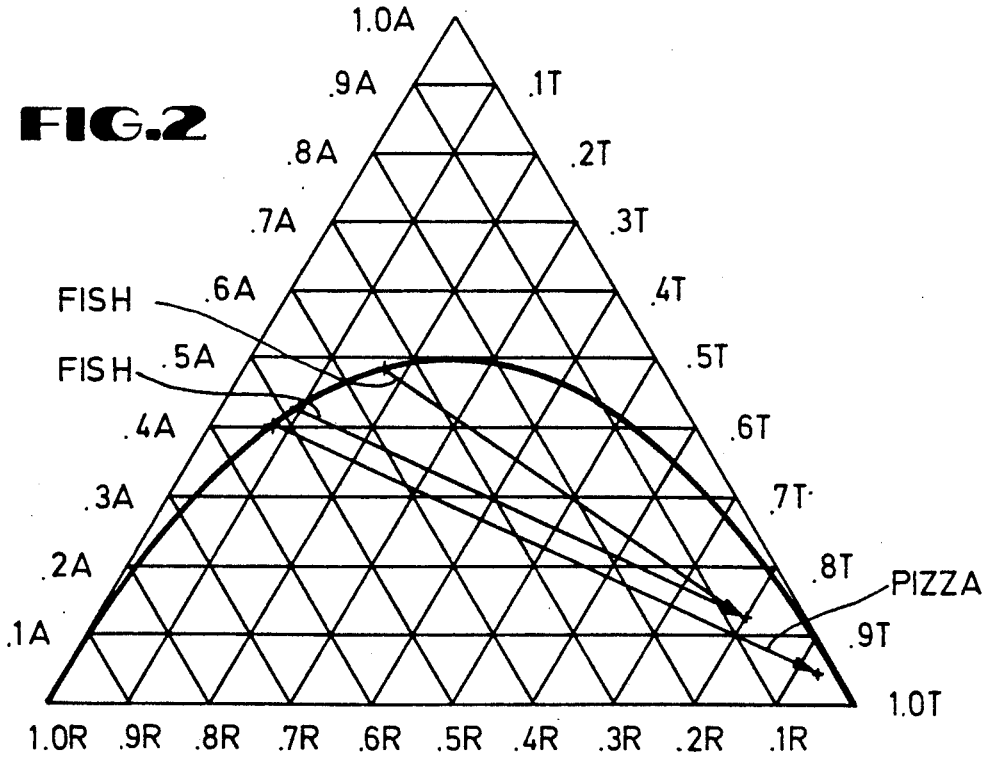
FIG. 2 is a tricoordinate plot showing the measured values of absorbance, reflectance and transmittance for two examples of conventional susceptors, before and after heating food products.

The effect of breakup can be further understood by considering FIGS. 1 and 2. FIG. 1 shows output from a computer model of susceptor absorption in free space versus surface resistance (the real part of the susceptor surface impedance) for several values of surface reactance, the imaginary part of the impedance. Reflectance, transmittance and absorbance values described herein refer to free space values unless otherwise noted. FIG. 2 is a tricoordinate plot of susceptor reflection, absorption and transmission. The curve in FIG. 2 is the theoretical locus of R, A and T points for perfectly resistive susceptors (i.e., no reactance). The data from Table 1 have been plotted in FIGS. 1 and 2; the changes in susceptor performance characteristics associated with breakup resulting from microwave heating for these conventional susceptors are clearly evident.

In contrast, susceptors made in accordance with the present invention become substantially more microwave reflective, i.e., the reflectance increases, at elevated cooking temperatures, when compared to the reflective characteristics of the same susceptor measured at or near room temperature. The susceptor typically also becomes substantially less transmissive at elevated cooking temperatures.

The resulting temperature compensating susceptor may function in cooking somewhat like a thermostated electric frying pan: the susceptor may be highly microwave absorptive at low temperature and significantly less absorptive and transmissive at elevated temperatures, for example, above 220° C. The most desirable susceptors of this invention undergo such changes substantially reversibly.

A Presently Preferred Embodiment

A presently preferred embodiment of a susceptor made in accordance with this invention is shown in FIG. 3, and indicated generally with reference numeral 50. The susceptor 50 has a microwave interactive heating layer 51 which heats responsive to microwave radiation. In this preferred example, the microwave interactive heating layer 51 is deposited upon a substrate 52. The substrate 52 may be a sheet of polyester. This forms a composite sheet 51, 52 which may be referred to in this example as metallized polyester, or more genericly as coated polyester. The metallized polyester 51, 52 is adhesively bonded to a support member 53.

Figure 5A:
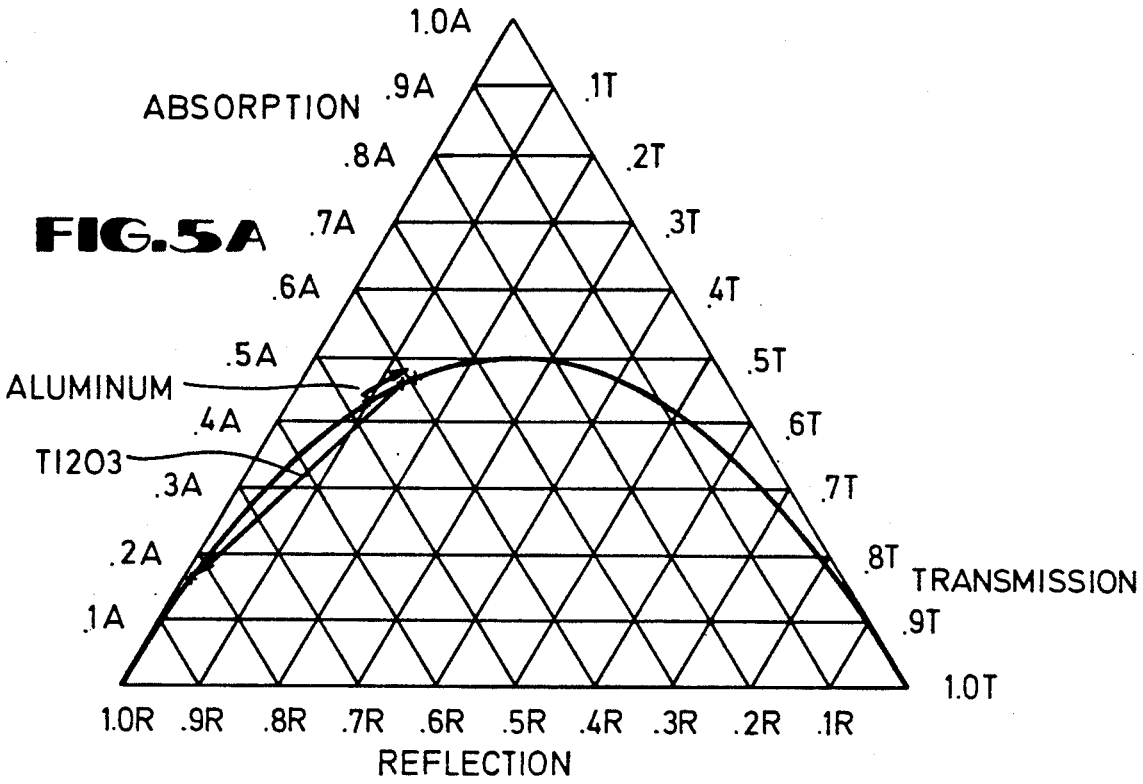
FIG. 5A is a tricoordinate graph showing temperature dependent values of reflection, absorption and transmission for a titanium sesquioxide susceptor constructed in accordance with the present invention.

The microwave interactive heating layer 51 is responsive to the electric field component of the microwave radiation, and will heat when placed in a microwave oven and exposed to microwave radiation. In accordance with the present invention, the microwave interactive heating layer 51 is constructed such that the susceptor 50 becomes more reflective when the susceptor is heated by microwave radiation. It has been discovered that this effect can be achieved by using carefully selected materials for the microwave interactive heating layer 51. In this preferred embodiment, the microwave interactive heating layer 51 preferably is made of titanium sesquioxide, i.e., $Ti_2O_3$. A tricoordinate plot showing the temperature response of a susceptor constructed in accordance with the present invention is shown in FIG. 5A. This example used a susceptor made predominantly of $Ti_2O_3$, and it illustrates the principle of operation of the present invention. When heated, the reflection increased from about 40% to more than 80%. The transmission decreased from about 15% to less than 3%. FIG. 5A also compares an aluminum susceptor, not made in accordance with the present invention. The aluminum susceptor, by comparison, decreased in reflection, and increased in transmission.

Figure 6:
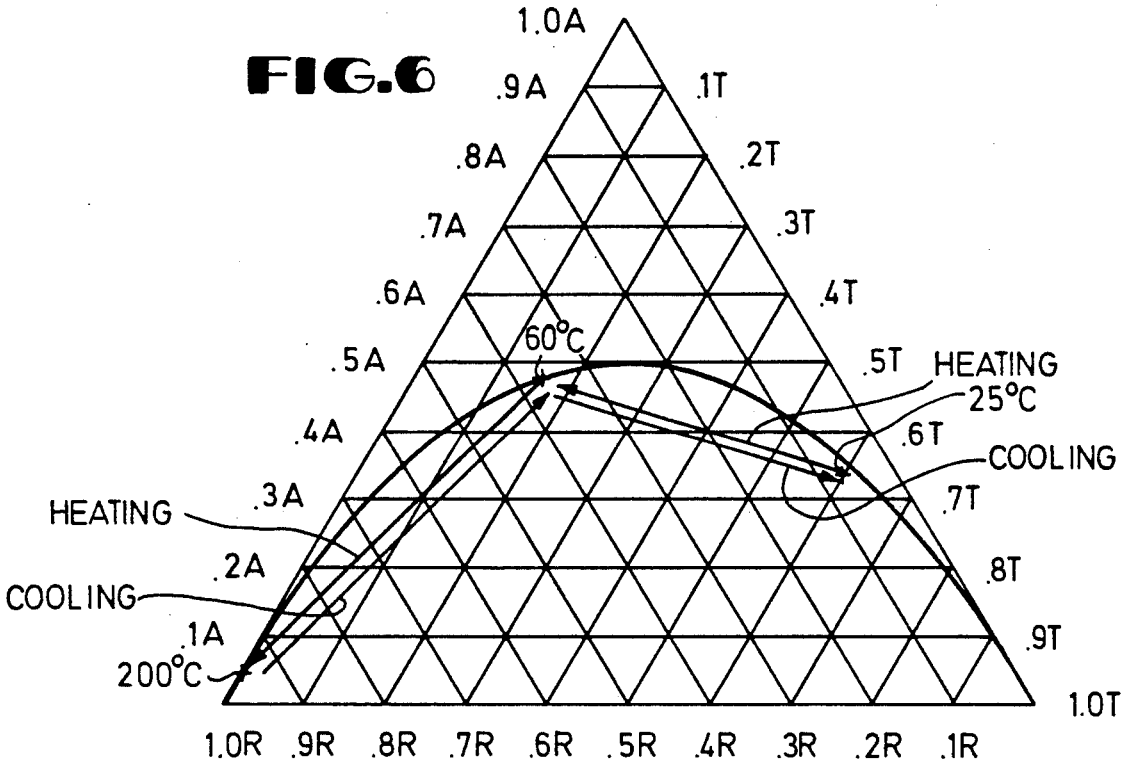
FIG. 6 is a tricoordinate graph showing temperature dependent values of reflection, absorption and transmission for a semiconductor susceptor constructed in accordance with the present invention.

The temperature dependent changes in reflection, transmission and absorption preferably are reversible characteristics of the illustrated example of the present invention. When the susceptor 50 cools, the susceptor 50 may substantially return to its original values of transmittance, reflectance and absorbance. This is shown in FIG. 6.

The composite susceptor structure 50 has a transmittance greater than 0.1%, and more preferably greater than 1%, when measured at room temperature prior to microwave heating. The support member 53 preferably is a dielectric material which is substantially transparent to microwave energy. Where a support member 53 is present, it should have a microwave transmittance greater than 80% when measured alone and at room temperature.

An alternative embodiment of a susceptor 54 is shown in FIG. 4. In this example, a microwave interactive heating layer 55 is shown deposited directly upon a substrate 56, which may also serve the function of a support member. The substrate 56 preferably is a dielectric material which is substantially transparent to microwave energy, having a transmittance greater than 80% when measured at room temperature prior to heating. The substrate 56 may be a clay-coated paperboard, with the microwave interactive heating layer 55 deposited directly on the clay side of the substrate 56. The microwave interactive heating layer 55 preferably is a thin film predominantly comprising $Ti_2O_3$. The food to be heated is placed in contact with the microwave interactive heating layer 55.

Another alternative embodiment is shown in FIG. 5. The susceptor 57 has a microwave interactive heating layer 55 deposited on a substrate 56, and may be constructed substantially as described above with reference to the example shown in FIG. 4. In this example, the food to be heated is placed in contact with the paper substrate 56, rather than the microwave interactive heating layer 55.

The microwave interactive heating layer is formed with a material which becomes significantly more electrically conductive with increasing temperature. In other words, the surface resistance of the microwave interactive heating layer decreases significantly during microwave heating. The microwave interactive heating layer also remains essentially continuous without significant breakup during microwave heating.

Figure 7:
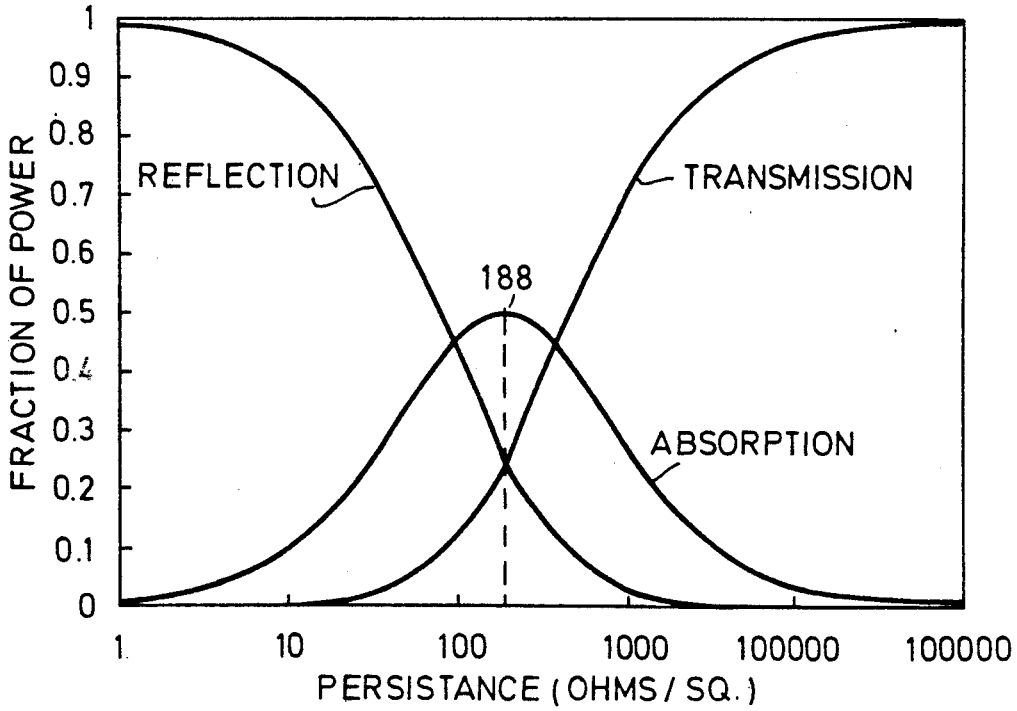
FIG. 7 is a theoretical plot showing reflection, absorption and transmission as a function of surface resistance for a free space susceptor model.

This temperature dependence of electrical conductivity may be better understood with reference to FIG. 7. FIG. 7 is a graph which depicts the theoretical reflection, absorption and transmission as a function of the surface resistance of the susceptor for a susceptor which has an essentially continuous film and which does not break up. If the microwave interactive heating layer is made from a material which has a surface resistance which decreases with increasing temperature, and the susceptor does not break up, certain ramifications in the operation of the susceptor may be described with respect to FIG. 7. As the surface resistance of the susceptor decreases, the operation of the susceptor will move to the left in the graph of FIG. 7. As the surface resistance decreases with increasing temperature, the reflection increases. As the surface resistance decreases with increasing temperature, the transmission will also decrease. If initial susceptor surface resistance values are selected which place the susceptor toward the left of the graph, a susceptor which has a surface resistance that significantly decreases with increasing temperature can provide low absorption and transmission and high reflection at elevated temperatures. If the susceptor has low absorption at elevated temperatures, it will heat less responsive to microwave radiation. In practice, heating will tend to reach a steady state maximum temperature where the rate of heating based upon the absorption at that temperature will be just enough to offset the heat lost (through radiation, conduction, convection, etc.).

Where a susceptor has less transmission at elevated temperatures, the amount of microwave energy which is transmitted through the susceptor and which is permitted to heat the food through dielectric heating is reduced. Because the susceptor has high reflection, more microwave energy will be reflected back away from the food product to reduce the microwave heating effects upon the food. Thus, potentially excessive dielectric heating of the food may be significantly reduced at elevated temperatures by using a susceptor constructed in accordance with the present invention.

FIG. 7A shows the change in reflection, transmission, and absorption for a susceptor having a microwave interactive heating layer formed of $Ti_2O_3$. The reactive component of the impedance was negligible. The susceptor had an initial surface resistance of about 107 ohms per square at room temperature. The effect upon the reflection, absorption and transmission as a result of heating to a temperature of 250° C. is shown in FIG. 7A. In effect, the susceptor shifted position on the graph to a location to the left of the initial operating position. The reflection of the susceptor increased significantly as a result of increasing temperature. The absorption decreased as a result of increasing temperature. The transmission also decreased as a result of increasing temperature. Thus, the amount of microwave energy which was transmitted through the susceptor reduced when the temperature increased, the amount of absorption reduced when the temperature increased, and the amount of microwave energy which was reflected increased. A susceptor with these operating characteristics would have a desirable temperature limiting heating performance.

When the microwave interactive heating layer is essentially electrically continuous and made from a good conductor, the surface reactance (the imaginary part of the surface impedance) of a susceptor may be generally small, for example, between 0 and −50 reactive ohms per square. Under such conditions, only the real part of the surface impedance, the surface resistance, is significant. Surface resistance is related to the electrical conductivity of the microwave interactive heating layer. This relationship may be expressed as follows:

$$R_s = \frac{1}{\sigma d}$$

where $R_s$ is the surface resistance, measured in ohms per square, $\sigma$ is the electrical conductivity of the microwave interactive heating layer, expressed in units of:

$$\frac{1}{\text{(ohm-centimeter)}},$$

and d is the thickness of the susceptor material, expressed in centimeters. If the electrical conductivity of the material that is used to make the microwave interactive heating layer is temperature dependent, then the surface resistance will also be temperature dependent. In particular, if the conductivity increases with temperature, then the surface resistance will decrease over the same temperature range.

The graph of FIG. 7 is based upon a free space susceptor model. In this free space model, the peak of the absorption curve occurs for a surface resistance of 188 ohms per square. It is desirable to select a microwave interactive heating layer material which results in a susceptor having a surface resistance to the left of the peak of the absorption curve. For the free space model shown in FIG. 7, it would be desirable to have a surface resistance less than 188 ohms per square at room temperature prior to microwave heating.

In practice, the peak of the absorption curve for a susceptor may occur at a different value of surface resistance from that shown in FIG. 7, because the graph of FIG. 7 is based upon a free space model. The values of the surface resistance on the horizontal axis may change, but the relative relationships shown by the curves will remain valid.

The location of the peak of the absorption curve may be dependent upon the load characteristics of a food product, when considering an example which has a susceptor in combination with a food product placed thereon. Peak absorption may be food product dependant. The location of the absorption curve may shift relative to the horizontal axis values of surface resistance, but the shape of the curve will generally remain the same.

The electrical conductivity of the microwave interactive heating layer should preferably increase by a factor of at least three between room temperature (20° C.) and 220° C.; it should more preferably increase by a factor of 10; it should most preferably increase by a factor of 100. At 220° C., the electrical conductivity of the microwave interactive heating layer measured at microwave frequency preferably should be greater than about 1(1/ohm-centimeter). The electrical conductivity should more preferably be greater than about 1000(1/ohm-centimeter), and most preferably greater than about 20000(1/ohm-centimeter). The microwave interactive heating layer should preferably be less than 200 microns thick, and should more preferably be less than 1 micron thick, and should even more preferably be less than 1000 Angstroms thick. At 220° C., the microwave electrical surface resistance should preferably be less than 50 ohms per square, more preferably less than 10 ohms per square, and most preferably less than 5 ohms per square.

The present invention is primarily concerned with heating responsive to the electrical component of the microwave field. The amount of heating which results from absorption of the electrical component of the microwave field is related to $\epsilon''_{EFF}$. The symbol $\epsilon''_{EFF}$ refers to the effective dielectric loss factor, as described in A. C. Metaxas and R. J. Meredith, *Industrial Microwave Heating* (1983), published by Peter Peregrinus, Ltd., which is incorporated herein by reference. Following the mathematical analysis developed in this reference, the conductivity and dielectric loss factor are related according to the following equation:

$$\epsilon'' = \frac{\sigma}{2\pi f \epsilon_0}$$

where $\sigma$ is the conductivity in 1/ohm-centimeter, f is the frequency of the microwave radiation, and $\epsilon_0$ is equal to $8.854 \times 10^{-14}$ farads per centimeter, and is used to represent the permittivity of free space. If the electrical conductivity of a material is known, this equation can be used to calculate the corresponding equivalent dielectric loss factor $\epsilon''$. Table 2 below shows the electrical conductivity of various materials of interest, which have either been determined from text book references or have been measured directly, and the calculated corresponding equivalent dielectric loss factor $\epsilon''$.

TABLE 2

| Material | Electrical Conductivity $\sigma$(ohm-cm)$^{-1}$ | Equivalent $\epsilon''$ |
|---|---|---|
| Al | | |
| at 20° C.* | $3.676 \times 10^5$ | $2.764 \times 10^8$ |
| at 250° C.* | $1.896 \times 10^5$ | $1.391 \times 10^8$ |
| at 20° C.+ | $1.222 \times 10^4$ | $8.951 \times 10^6$ |
| at 250° C.+ | $0.952 \times 10^4$ | $6.982 \times 10^6$ |
| $Ti_2O_3$ susceptor | | |
| at 23° C.+ | 43 | $3.15 \times 10^4$ |
| at 250° C.+ | 400 | $2.93 \times 10^5$ |
| Ge | | |
| at 20° C.* | 0.022 | 16.1 |
| at 23° C.+ | 0.053 | 38.9 |
| at 220° C.+ | 52.5 | $3.85 \times 10^4$ |

*Taken from the Handbook of Chemistry and Physics (65th ed. 1984), published by CRC Press, Inc.
+Measured experimentally From Table 2 it is apparent that the conductivity of aluminum decreases by nearly a factor of two between room temperature and about 250° C. Over approximately the same temperature range, the $Ti_2O_3$ susceptor (made in accordance with the present invention) becomes 9.3 times more conductive, and the germanium susceptor (made in accordance with the present invention) becomes 990 times more conductive.

The present invention is sharply distinguishable from prior attempts to utilize the Curie effect of certain microwave absorbing materials which heat in response to the magnetic component of the microwave field. Microwave heaters such as those proposed by Anderson et al. in U.S. Pat. No. 4,266,108, which rely upon absorption of the magnetic component of the microwave field, have been of limited usefulness. The relatively small magnitude of the magnetic loss factor $\mu''$ of known materials limits the usefulness of such microwave heaters. The present invention, which utilizes heating based upon the electric component of the microwave field, which is dependent upon the dielectric loss factor $\epsilon''$, is significantly superior. The present invention may be compared with prior magnetic type heaters utilizing the Curie effect by comparing the relatively small magnitude of the magnetic loss factor $\mu''$ of known materials to the dielectric loss factor $\epsilon''$ of available materials. For example, the table appearing in column 5 of the Anderson et al. reference shows $\mu''=5.84$ for the disclosed $Mg_2Y$ ferrite heater; in contrast, the dielectric loss factors $\epsilon''$ tabulated in Table 2 above are generally very much larger by comparison. A significant advantage may be achieved in practice based upon this difference. Susceptors made in accordance with the present invention which rely upon absorption of the electrical component of the microwave field may be many times thinner and require corresponding less material to manufacture the susceptor, than would be the case with corresponding devices which rely upon absorption of the magnetic component of the microwave field.

Figure 15:
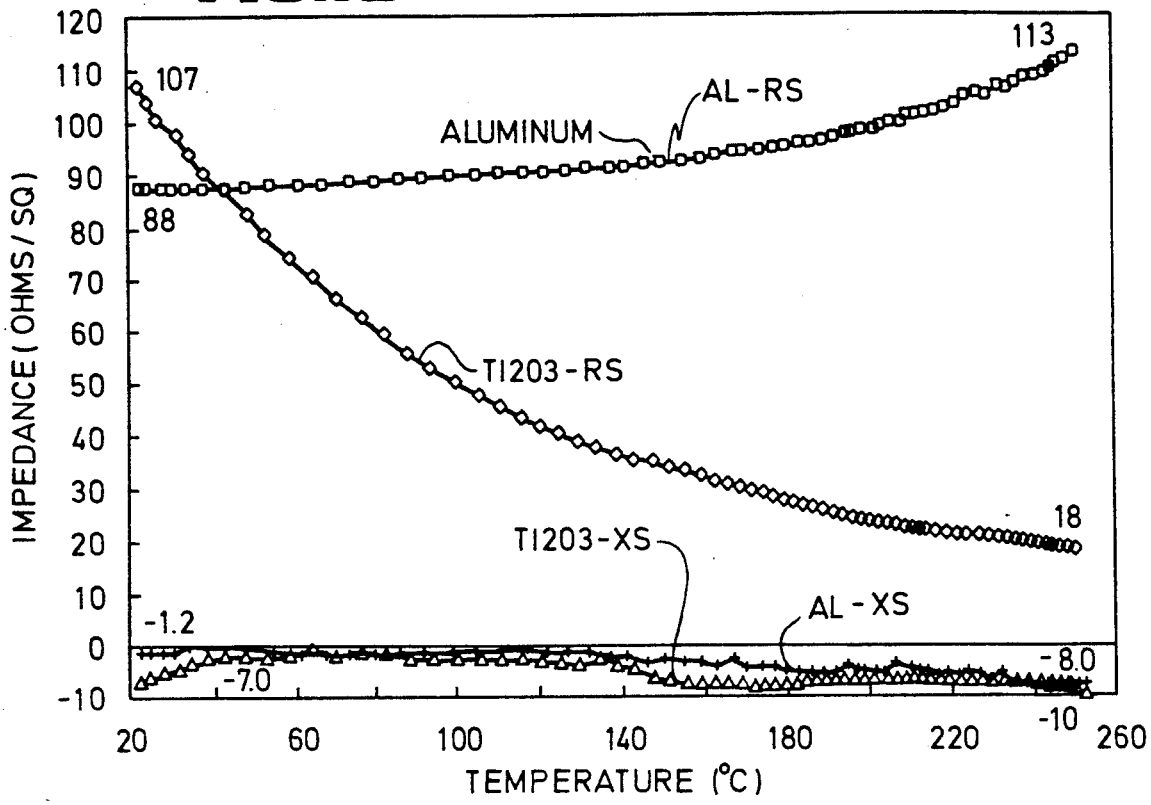
FIG. 15 is a graph comparing the temperature dependent impedance of a titanium sesquioxide ($Ti_2O_3$) susceptor with an aluminum susceptor.
Figure 16:
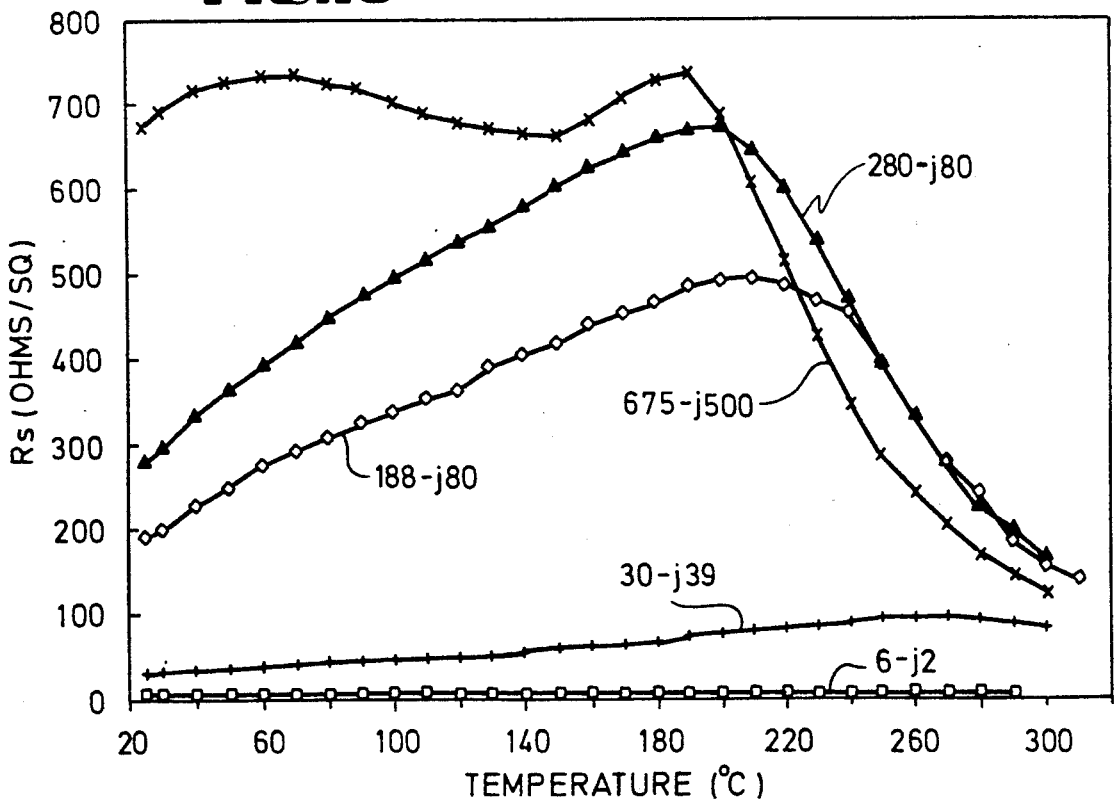
FIG. 16 is a graph showing the temperature dependence of surface resistance for semiconductor susceptors having various levels of doping and corresponding room temperature impedance.

FIG. 15 is a graph showing experimental results wherein the surface resistivity of a susceptor having a microwave interactive heating layer predominantly composed of $Ti_2O_3$ is compared with a susceptor, not made in accordance with the present invention, using a thin film of aluminum deposited on a polymide substrate. In this example, the polymide substrate was obtained from the General Electric Company, and was identified by the trademark Kapton. Using the test apparatus shown in FIG. 10, the surface resistivity was measured for various temperatures. The surface resistivity of the susceptor made in accordance with the present invention decreased with increased cooking temperatures, while the surface resistivity of the conventional aluminum susceptor increased slightly with increased temperature. This difference in the temperature dependence of the resistivity of the susceptor constructed in accordance with the present invention versus a conventional aluminum susceptor has a significant impact upon the performance of the susceptor in a microwave oven.

Useful materials for the microwave interactive heating layer include the so-called Magneli phases of the titanium-oxygen system. These include, but are not limited to, $Ti_2O_3$, $Ti_3O_5$, and $TiO_x$ where x has a value between two and one.

Other useful materials for the microwave interactive heating layer are semiconductors, which generally become significantly more electrically conductive with increasing temperature. Useful semiconductors include materials whose electrical conductivity is temperature dependent over at least part of the temperature range between room temperature and 250° C.

The microwave interactive heating layer with a temperature dependent electrical conductivity may be achieved by making the layer from a material which undergoes an insulator to metal transition with increasing temperature. For such materials, the insulator-metal transition temperature should preferably be between about 100° C. and about 250° C., more preferably between about 150° C. and about 250° C., and most preferably between about 200° C. and about 250° C.

Figure 7B:
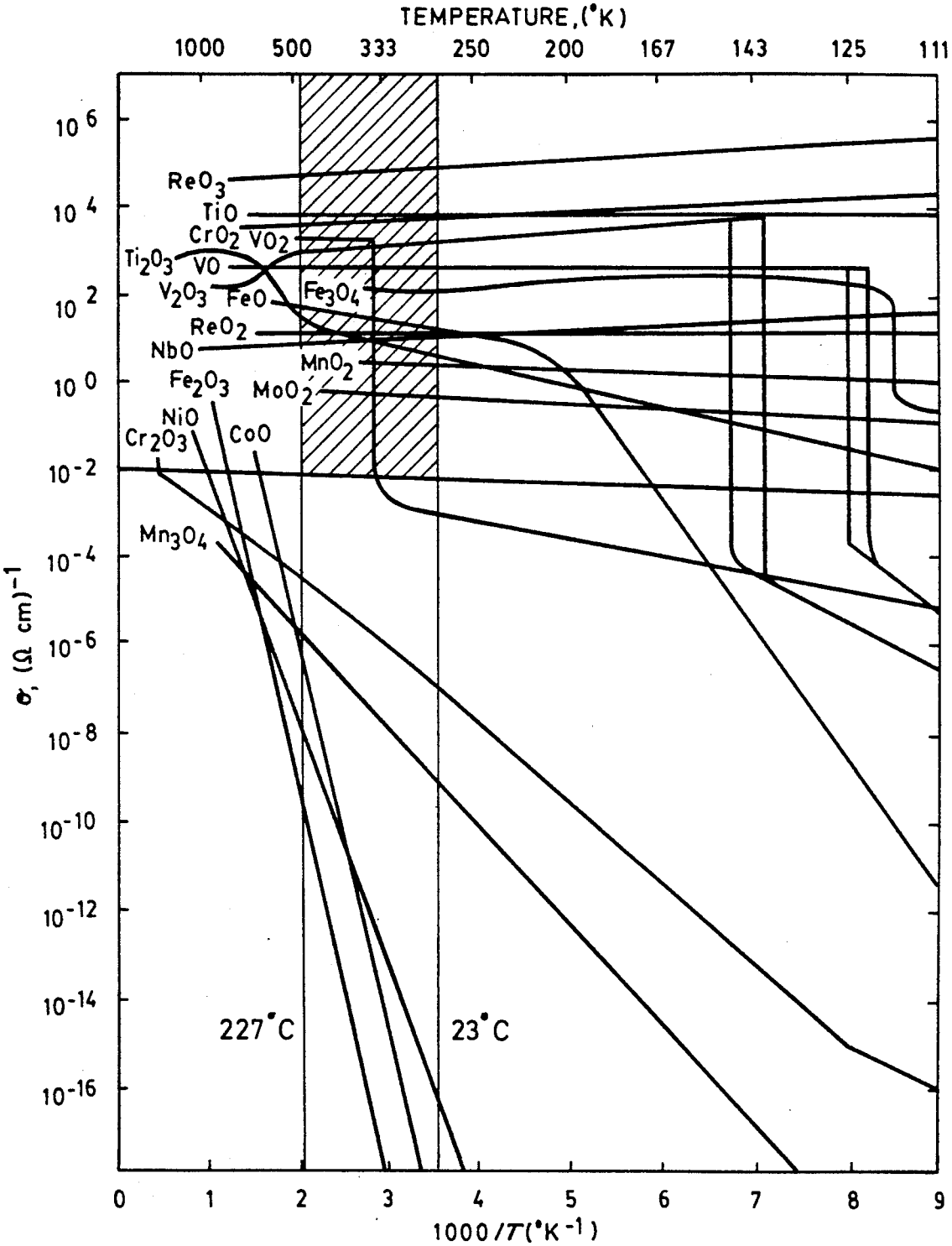
FIG. 7B is a graph showing temperature dependence of the electrical conductivity of certain materials in a range of interest for the present invention.

Additional useful materials for the microwave interactive heating layer include germanium, silicon, vanadium oxides, such as $VO_2$, $V_2O_3$, $V_3O_5$, nickel (II) oxide, i.e., NiO, and the tungsten bronzes. FIG. 7B is a graph showing the temperature dependence of the electrical conductivity of several materials. The temperature range of particular interest for purposes of the present invention is between 23° C. and 250° C. Materials having a conductivity greater than $10^{-2}$ within this temperature range are also of particular interest for purposes of the present invention. Thus, the performance of materials in the cross-hatched rectangular area shown in FIG. 7B is of particular interest. Materials which have a significant temperature dependence, and whose electrical conductivity increases with increasing temperature within the rectangular area shown in FIG. 7B may be suitable for the microwave interactive heating layer of the present invention. An even more preferred region of desired performance is shown in FIG. 7C. It should be noted, in FIGS. 7B and 7C, that the horizontal temperature scale is plotted so that temperature decreases moving left to right on the horizontal scale.

Alternative Embodiments

FIG. 8 illustrates an alternative embodiment of a susceptor 58. The susceptor 58 comprises a microwave interactive heating layer 59 made from a wafer of semiconductor material.

Certain semiconductors exhibit a temperature dependent increase in electrical conductivity which may be described by an Arrhenius relationship, as shown in the following equation:

$$\sigma = A \exp\left(\frac{-E_g}{2kT}\right)$$

where $\sigma$ is the conductivity (1/ohm-centimeter), A is a constant which is dependent in part upon carrier density and mobility, $E_g$ is the band gap energy expressed in electron volts (eV), k is Boltzman's constant, and T is the temperature expressed in degrees Kelvin. This equation is taken from W. D. Kingery et al., *Introduction to Ceramics* (2d ed. 1976), published by John Wiley & Sons, the entirety of which is incorporated herein by reference. This equation may be substituted into the first equation given above to provide the relationship between surface resistance and the characteristics of the semiconductor material. Surface resistance may, in turn, be related to absorption, reflection and transmission through the relationships shown in the graph of FIG. 7.

For a semiconductor material, the rate of conductivity change with temperature depends on the band gap energy $E_g$. The band gap energy is one criteria by which a suitable semiconductor material may be selected to provide a desired temperature dependent response. For example, silicon which has a relatively large band gap energy ($E_g$=1.1 eV) will show a correspondingly large rate of change in conductivity with temperature. Materials with smaller band gap energies such as lead sulfide (Eg=0.35 eV) would produce a fairly modest rate of change in conductivity with temperature. Germanium (Eg=0.67 eV) and gallium antinomide ($E_g$=0.72) would yield intermediate responses. Band gap energies are tabulated in the *Encyclopedia of Semiconducting Technology* (1984), edited by Martin Grayson and published by John Wiley & Sons, Inc., the entirety of which is incorporated herein by reference.

Proper design is important to the performance of the susceptors of this invention. The susceptor will have the desired temperature compensating characteristics only if the thickness of the microwave interactive layer is chosen, in combination with the electrical conductivity of the microwave interactive layer, so that at high temperature the surface resistance falls substantially to the left side of the absorption peak in FIG. 7 where absorbed power is small (e.g., below 15%) and decreases with decreasing surface resistance. In this region, absorption will decrease with increasing temperature using a susceptor made in accordance with the present invention.

At elevated temperature (e.g., 220° C.), absorbed power should be less than 30%, preferably less than 15%, more preferably less than 10%, and most preferably less than 5%. For example, if the thickness and conductivity of the microwave interactive layer is chosen, by calculation or experiment, so that at elevated temperature (e.g., 220° C.) the surface resistance $R_s$ is about 5 ohms per square, FIG. 7 shows that absorbed power for this susceptor will be about 5%. Under these conditions, susceptor microwave absorption is low enough so that under continued microwave exposure further temperature increase (above 220° C.) is generally minimal. At room temperature, however, if the conductivity of the microwave interactive layer is lower, for example, by a factor of 10, then FIG. 7 shows that the surface resistance $R_s$ will be approximately 50 ohms per square and that in free space the susceptor will absorb over 30% of the incident power. This susceptor is therefore highly absorptive at or below room temperature and is significantly less absorptive and transmissive at elevated temperatures; it functions in the microwave oven to heat, crispen or brown foods substantially like a thermostated electric frying pan functions in conventional frying.

Figure 9:
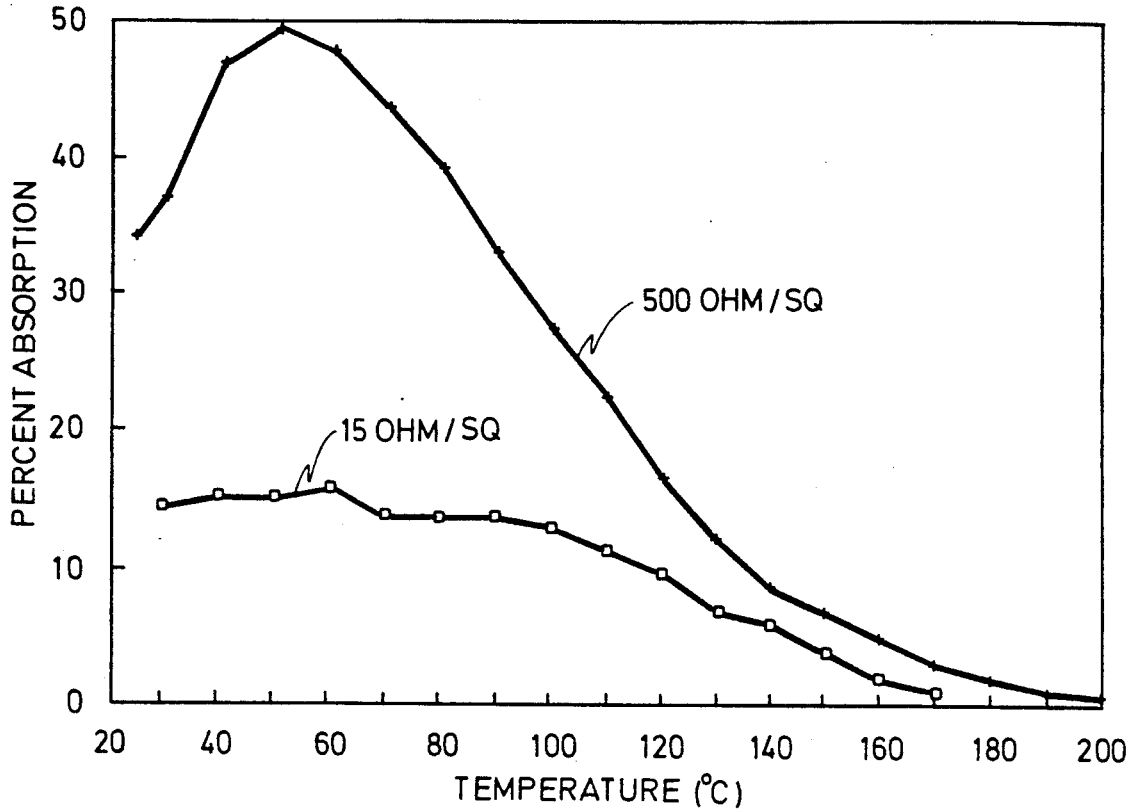
FIG. 9 is a graph showing the temperature dependence of absorption for two germanium semiconductor susceptors having room temperature surface impedances of 15 and 500 ohms per square, respectively.
Figure 11:
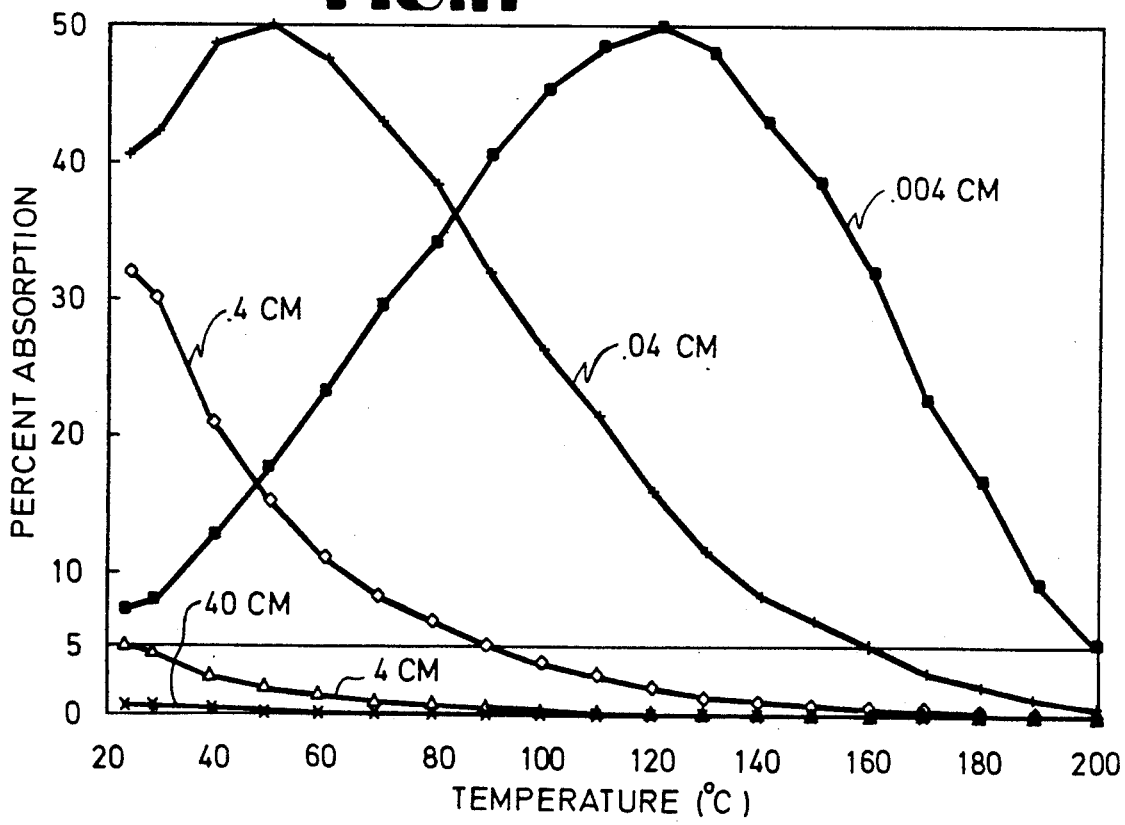
FIG. 11 is a graph showing calculated absorption versus temperature for five germanium semiconductor susceptors having different thicknesses.

The effect of thickness can be seen in FIG. 11, in which absorbed power versus temperature curves were calculated using the 500 ohms per square experimental data in FIG. 9 to calculate the temperature-dependent conductivity. Absorption versus temperature curves were then calculated for several assumed thicknesses using Equation 1 and the treatment described in R. K. Moore's book. A reference line corresponding to 5% absorption was drawn in FIG. 11 to facilitate comparison of the absorption curves. FIG. 11 shows that, for this germanium sample, if 5% absorption at 160° C. is required, a thickness of about 0.04 centimeter should be used. If 5% absorption at 200° C. is needed, the susceptor thickness should be about 0.004 centimeter. If 5% absorption at 90° C. is desired, the thickness should be about 0.4 centimeter.

Figure 12:
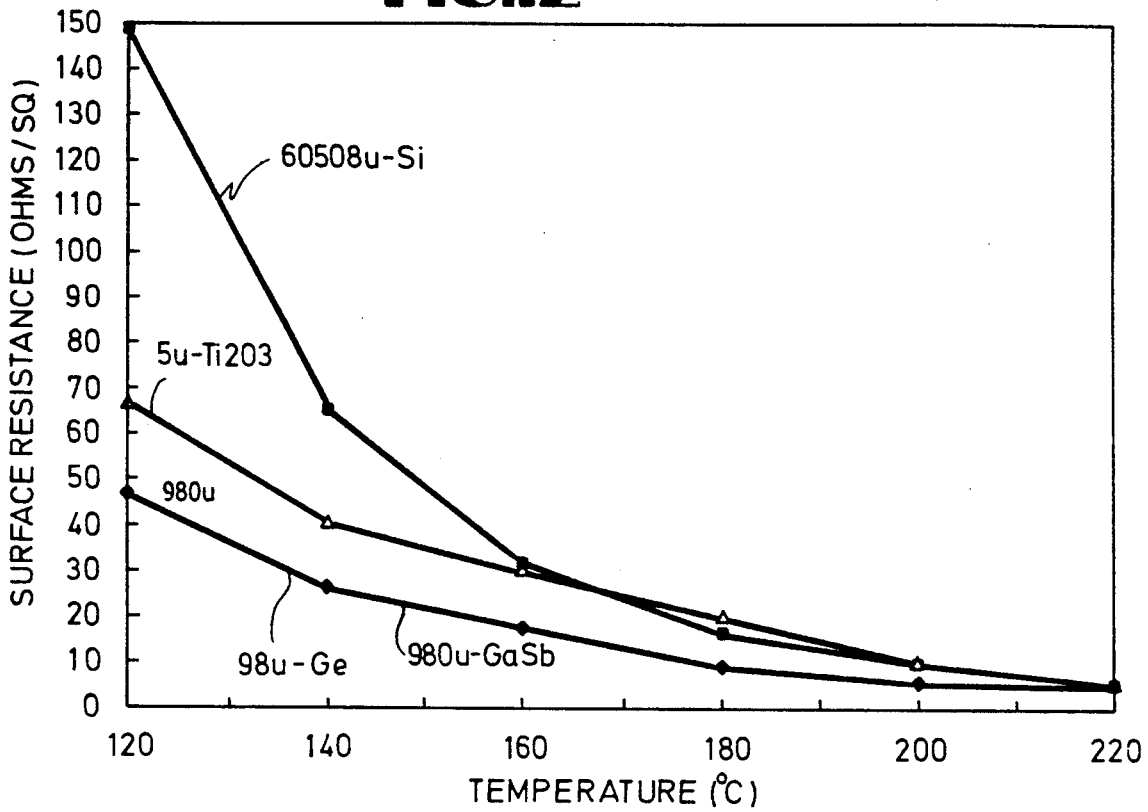
FIG. 12 is a graph showing the temperature dependence of surface resistance for silicon, germanium, gallium antinomide (GaSb) and titanium sesquioxide ($Ti_2O_3$).
Figure 13:
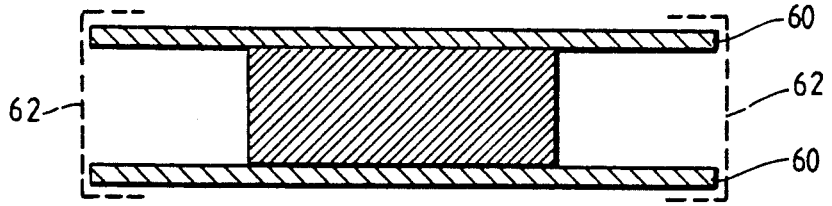
FIG. 13 is a schematic cross-sectional view of two susceptors constructed in accordance with the present invention used to cook a piece of meat.

FIG. 12 shows various materials whose conductivity significantly increases with temperature. In other words, these materials have positive temperature coefficients of electrical conductivity. The values printed at the beginning of each curve are the calculated thickness in microns needed to achieve a surface resistance $R_s$ of 5 ohms per square at 220° C.

Method of Making the Microwave Interactive Heating Layer

A microwave interactive heating layer in the form of a thin film with a predominant composition of $Ti_2O_3$ can be made by depositing titanium material in an oxygen atmosphere on neoceram glass, using reactive planar DC magnetron sputtering from a titanium target. FIG. 17 shows a diagram of a suitable sputtering apparatus.

In order to accomplish the deposition of a $Ti_2O_3$ film having the desired conductivity change with temperature, the deposition process must be carefully controlled. The optimal settings for a particular coating machine may be determined empirically. Also, modification of the coating machine can sometimes require that the settings for the particular coating machine be reoptimized in view of the modification.

As shown in FIG. 17, the neoceram glass or other suitable substrate material is cleaned and mounted on the sample holding drum of the sputter coating machine. The coating machine is pumped down to a vacuum better than $3.0\times10^{-6}$ torr. The entire coating process is conducted at about room temperature. After a good vacuum is established, and before coating commences, the titanium sputtering target is "presputtered" to clean it of any oxide or other impurities and to establish a consistent set of coating parameters, as is known in the art of sputtering. For this step of the process, the samples on the drum are rotated away from the sputtering targets and the drum rotation means is turned off.

For the presputtering step, the argon flow rate is set to 11.6 sccm's, the oxygen flow is set to zero, the DC magnetron is set to 1 kw, 3.0 amps and 336 volts. The auxiliary plasma is set to 140 volts, 0.8 amps DC. A sccm is a "standard cubic centimeter of gas per minute", measured at standard conditions of one atmosphere and 0° C. The presputter step normally lasts for at least ten minutes and is terminated when the magnetron voltage has stabilized. In this case power and current were held constant and magnetron voltage was monitored. It would have worked equally well to fix power and magnetron voltage and monitor the magnetron current.

A second presputter step then takes place in which the oxygen flow rate is adjusted to 9.08 sccm's and the sputtering voltage is set to 347 volts. When the magnetron current has stabilized again, the second presputtering step ends.

At this point, the drum rotation is turned on and deposition of $Ti_2O_3$ on the substrate is begun. Under the above conditions, the deposition rate is near 59 Å of $Ti_2O_3$ per minute. As the drum rotates, titanium atoms are deposited on the substrate when the substrate is brought near the planar magnetron sputtering target of titanium. As the drum continues to rotate, the titanium will be partially oxidized by oxygen species produced in the auxiliary plasma as the substrate rotates near the auxiliary sputtering target. The film thickness is calculated by the predetermined sputtering rate of 59 Å per minute, in this case, and the sputtering time.

The composition of the deposited film is inferred from the film's appearance, its room temperature conductivity, and the magnitude of the conductivity change with temperature. A good $Ti_2O_3$ film is dark blue, has a conductivity at room temperature of about 5(ohm-centimeter)$^{-1}$ or greater, and has a ratio of conductivity at 250° C. to conductivity at 25° C. of 5 or greater. If the deposited film is overly oxidized, i.e., the composition is too close to $TiO_2$, the film becomes progressively more nearly colorless, the conductivity is less than 2(ohm-centimeter)$^{-1}$, and the ratio of conductivity at 250° C. to the conductivity at 25° C. is less than 2.0. If the film is prepared with too little oxygen content, i.e., the film composition approaches TiO, the film appears metallic, the room temperature conductivity is above 200(ohm-centimeter)$^{-1}$, and the ratio of conductivity at 250° C. to the conductivity at 25° C. is less than 2.0. These guidelines are used to adjust the film deposition process to achieve the desired degree of titanium oxidation.

Additional disclosure relating to a suitable method and apparatus for depositing a thin film on a substrate is contained in U.S. Pat. No. 4,851,095, to Michael A. Scobey et al., entitled "Magnetron Sputtering Apparatus and Process", and in S. Schiller et al., "Alternating Ion Plating—A Method of High-Rate Ion Vapor Deposition", *J. Vac. Sci. Technol.*, Vol. 12, No. 4, pp. 858–64 (July/August 1975), both of which are incorporated herein by reference.

The material forming the microwave interactive heating layer may be deposited on a suitable substrate by several suitable methods which may include thin film deposition, plasma or flame spraying, sol-gel processing, spray pyrolysis, silk screening, or printing, or the layer may be formed by spin casting, extrusion, sintering, or casting and rolling (e.g., foils), which possibly lend themselves to being laminated to an additional substrate, or the microwave interactive layer may be impregnated into the substrate, or the microwave interactive layer may be formed from a material which intrinsically has the desired electrical properties, such as semiconductor wafers or semiconducting polymers.

Susceptors defined by this invention may be made from wafers of semiconductor material, which may be bonded to a support if desired for structural strength.

Semiconductor wafers may have impurities introduced into the wafer.

The microwave interactive heating layer may be formed from one or more components, which may be formed in one or more distinct layers, whose chemical or physical interaction may change at elevated temperatures to significantly increase the effective conductivity, and decrease the effective surface resistance.

Modification of the Heating Layer Using Doping

The material of the microwave interactive heating layer may be beneficially doped. In order to manipulate the magnitude of the conductivity change with temperature and the temperature at which the transition occurs. In particular, semiconductor materials such as germanium and silicon may be doped to affect the conductivity of the semiconductor and the temperature dependence thereof. In the case of semiconductor materials such as silicon and germanium, suitable doping techniques may include introducing impurities, such as boron, arsenic or phosphorous, into the semiconductor material using techniques such as ion implantation or diffusion, as is well known in the art of manufacturing semiconductor devices. Other examples of doping may be found in R. S. Perkins, A. Ruegg and M. Fischer, "PTC Thermistors Based on $V_2O_3$: The Influence of Microstructure Upon Electrical Properties", pp. 166–76, and in J. M. Honig and L. L. Van Zandt, "The Metal-Insulator Transition in Selected Oxides", *Annual Review of Materials Science*, pp 225–78 (1975), both of which are incorporated herein by reference.

Referring to FIG. 9, the electrical conductivity of a semiconductor heating layer 59 was adjusted by introducing impurities into the semiconductor by doping. Doping adds impurities to the semiconductor material which generally increases the room temperature conductivity and reduces the temperature dependence of the conductivity.

Experimental results are shown in FIG. 9 for two germanium susceptors, one of which had a surface resistance of 500 ohms per square and was undoped, and one of which had a surface resistance of 15 ohms per square and was doped. Both susceptors had decreased in power absorption from room temperature to operating temperature 220° C. The 15 ohms per square susceptor was heavily doped with phosphorous. The surface impedance was measured at several temperatures using the apparatus diagramed in FIG. 10.

FIG. 9 is a graph showing the effects of doping upon surface resistance as a function of temperature for two semiconductor susceptors made of germanium. Each susceptor was cut to a size of 1.5 inches by 3.0 inches. Each susceptor was 0.015 inch thick. The temperature dependence of surface resistance is shown for two different susceptors, having initial surface resistances of 500 ohms per square and 15 ohms per square, respectively. The semiconductor susceptor which was more heavily doped had a lower initial surface resistance. In other words, the semiconductor susceptor whose initial surface resistance was 15 ohms per square was a more heavily doped susceptor, whereas the semiconductor susceptor whose initial surface resistance was 500 ohms per square was a more lightly doped susceptor.

If the microwave interactive layer is deposited by sputtering, the impurity may be incorporated into the sputtering target or the impurity may be co-sputtered along with the primary component of the film. If the film is deposited by vacuum evaporation, the dopant may be added to the boat containing the primary film component or it may be evaporated from a separate source.

Chemical modification techniques may also be used to introduce impurities. Co-sputtering techniques or any other simultaneous deposition technique may be used.

Modification of Temperature Variation of Semiconductor Conductivity Through Dopant Selection To reduce the material thickness and simultaneously maintain a useful value of surface resistance, it may be necessary to increase the conductivity of the susceptor material. Furthermore, the surface impedance must change with temperature to provide the desired temperature limiting effect.

Careful selection of the dopants used to modify the conductivity of the semiconductor permits an increase in room temperature conductivity while maintaining a significant change in resistance with temperature. Thus, the material thickness is reduced from the undoped case and the increase in conductivity with increasing temperature necessary for temperature limiting is maintained.

Conventional dopants in germanium and silicon are chosen so that the dopant atoms are essentially ionized, i.e., have all contributed a carrier to the conduction band or the valence band, at room temperature. The conductivity of these doped semiconductors decreases with increasing temperature until a temperature is reached at which the thermally generated hole-electron pairs from the base material outnumber the carriers from the ionized dopant atoms. Beyond this temperature the semiconductor becomes more conductive as temperature increases.

By choosing donor dopants that have ionization energies several tenths of an electron volt below the conduction band or acceptor dopants that have ionization energies several tenths of an electron volt above the valence band, appreciable fractions of these dopants will not be ionized at room temperature and thus will not contribute to the conductivity at room temperature. The conductivity of the doped material will be higher than the undoped material because some of the dopants will be ionized. As temperature increases, the fraction of the dopant atoms that are ionized will increase rapidly and despite a decrease in the mobilities with increasing temperature the conductivity will increase with increasing temperature.

Figure 19:
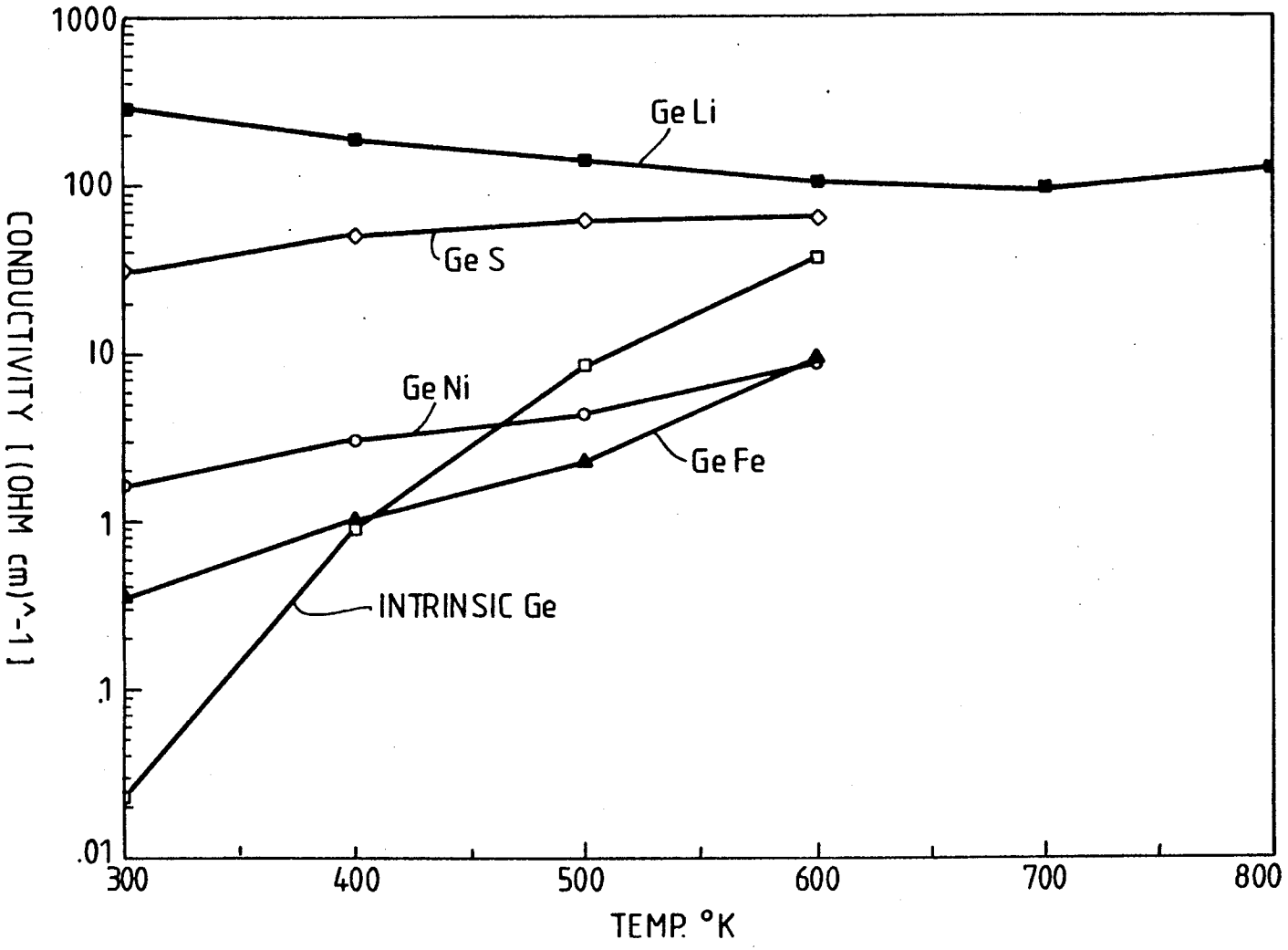
FIG. 19 is a graph showing the effects of dopants on the variation of conductivity with temperature for germanium.

The effects of dopants on the variation of conductivity with temperature are shown in FIG. 19 for germanium. Using iron dopant at a level of $10^{18}$ atoms per cubic centimeter in germanium increases the room temperature conductivity by a factor of 16 over the conductivity of undoped germanium. The conductivity of the iron doped germanium increases by a factor of 26 as the temperature increases from 300° K. to 600° K. Iron dopant in germanium has an ionization energy of 0.31 electron volts. Similarly, doping silicon with carbon at a level of $10^{18}$ is atoms per cubic centimeter increases the room temperature conductivity by a factor of 285,000. The conductivity of the carbon doped silicon increases by a factor of 4.9 as the temperature increases from 300° K. to 600° K.

The calculations were made from the material presented in the following: *An Introduction to Semiconductor Electronics*, by Rajendra P. Nanavati, McGraw-Hill Book Co., 1963; *Physics of Semiconductor Devices*, 2d ed., by S. M. Sze, John Wiley & Sons, 1981; *Physics and Technology of Semiconductor Devices*, by A. S. Grove, John Wiley & Sons, 1967, all of which are incorporated herein by reference.

Modification of the Heating Layer Using Artificial Dielectrics

Figure 18:
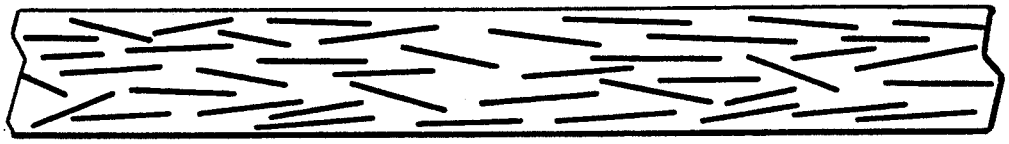
FIG. 18A shows a plan view of a portion of a susceptor whose active layer is made of material filled with metal plates.
FIG. 18B is an edge view of the material shown in FIG. 18A.
FIG. 18C is an edge view of a susceptor similar to FIG. 18B but with randomly oriented plates.

Some materials used to make the microwave interactive heating layer may have a low electrical conductivity and therefore require impractical or uneconomical thicknesses to achieve a desired surface resistance range. The thickness of the microwave interactive heating layer may be reduced to a more desirable range without sacrificing the desired ratio of conductivity change. This reduction in layer thickness may be accomplished by incorporating a series of conductive plates into the microwave interactive heating layer, as shown in FIGS. 18A, 18B and 18C. The size of the conductive plates and the spacing between conductive plates may be adjusted to increase the complex dielectric permittivity $\epsilon$ of the microwave interactive heating layer.

The complex permittivity of the microwave interactive layer is $\epsilon = 68_0\epsilon_r = (\epsilon'_r - j\epsilon''_r)$ where $\epsilon_0$ is the permittivity of free space, $8.854\times10^{-14}$/farads per centimeter, and $\epsilon'_{rk}$ is the real part of the complex relative dielectric constant $\epsilon_r$. The imaginary part of the complex relative dielectric constant is $\epsilon''_r$, which is related directly to the conductivity $\sigma$ of the material by $\epsilon''_r = \sigma/(W\epsilon_0)$, where W is equal to $2\pi f$, where f is the operating frequency of the microwave oven. When $\epsilon''_r$ greatly exceeds $\epsilon'_r$ of the layer, as is the case for aluminum, the layer may be characterized by a surface resistance $R_s = 1/(\sigma d)$, where d is the layer thickness. For materials without such a great disparity between $\epsilon''_r$ and $\epsilon'_r$, the concept of a complex surface impedance of an electrically thin layer given approximately by:

$$Z_s = \frac{1}{jW\epsilon_0\epsilon_r d}$$

is useful for the computation of reflected, absorbed and transmitted power. Elementary transmission line theory may be used to calculate the fraction of the incident power dissipated in the susceptor which is represented as a shunt impedance across the transmission line.

Thus, it may be seen that the surface $Z_{sk}$ is inversely proportional to $\epsilon_r$ and d. The ability to increase $\epsilon_r$ provides a smaller thickness d for the microwave interactive heating layer necessary in order to achieve a desired surface impedance $Z_s$.

The artificial dielectric material shown in FIGS. 18A and 18B is composed of a plurality of highly conductive metal objects 71 physically loaded into the original dielectric material 72. This loading will increase the complex dielectric constant $\epsilon$ and hence the loss factor $\epsilon''$ of the loaded material by a factor determined by the size, shape, orientation, and spacing of the metal inclusions 71. The increase in loss factor $\epsilon''$ occurs at all temperatures. The thickness of the microwave interactive layer 73 may thus be reduced to a more desirable range without sacrificing the desired ratio of loss factor change with temperature. Further information on the influence of loading on the electromagnetic properties of a loaded media may be found in the following: Sergi A. Shelkunoff & Harald T. Friis, *Antennas—Theory and Practice*, (1952), published by Wiley & Sons, Inc., and Robert E. Collin, *Field Theory of Guided Waves*, (1960), published by McGraw-Hill Book Co, both of which are incorporated herein by reference.

The metal objects 71, each of which is small with respect to the wavelength in the unloaded material, may take different forms. Square flat plates 71 suitably arranged in offset layers as shown in FIGS. 18A and 18B are preferred. Square flat plates 71 have a relatively large multiplicative effect on the complex dielectric constant when compared to the effect of ellipsoids, wires and other shapes.

In FIG. 18A, the square metal plates 71 with sides of length h lie in the plane of the susceptor and are separated from one another by a gap t between edges. Adjacent layers are spaced a distance $d_1$ apart and are preferably offset horizontally and vertically by half a repeat cell width, $(h+t)/2$. FIG. 18B shows an edge view of the same susceptor wherein layers are spaced apart a distance $d_1$. Although the dielectric material 72 surrounds the plates 71, the material 72 between opposing plates in the nearest layer is highlighted by crosshatching in FIG. 18B since it forms the dielectric part of the current path.

The effect of the stack of metal arrays 71 is to multiply the complex dielectric constant of the unloaded material by a factor of:

$$S = \left(\frac{h-t}{2d_1}\right)^2$$

for electric fields in the plane of the susceptor. If the plates 71 are arranged so that the interlayer spacing $d_1$ is much smaller than $h-t$, then the dielectric constant $\epsilon$ and hence the conductivity $\sigma$ are multiplied by a large number. $\epsilon_1$ is equal to $\epsilon_0\epsilon_{r1}$ where $\epsilon_0$ is the permittivity of free space ($8.854\times10^{-14}$ farads per centimeter), and $\epsilon_{41}$ is the complex relative dielectric constant of the unloaded material.

The amount of microwave power absorbed in a dielectric layer 70 of a given total thickness d may be adjusted by changing the size and spacing of the plates 71 loading that dielectric medium 72 without changing the total thickness.

Loading a media 72 of total thickness d with highly conductive plates 71 multiplies the complex dielectric constant of the unloaded media by the factor S so the surface impedance $Z_{sp}$ of a susceptor 73 made with the conductive plate filled material is reduced by the same factor S:

$$Z_{sp} = \frac{1}{jW\,S\,\epsilon_0\epsilon_{r1}\,d} = \frac{Z_s}{S}$$

The S factor and the susceptor thickness d enter into the expression as a product; thus, the surface impedance may be lowered by increasing the susceptor thickness or by increasing S.

The perfect geometrical arrangement shown in FIGS. 18A and 18B may be expensive to build, but may be adequately approximated when thin plates 71 whose broad surfaces are nearly parallel to the plane of the susceptor are otherwise randomly placed in the susceptor 73 as shown in FIG. 18C. The essential features are the overlap regions shown as shaded in FIG. 18A which are not so orderly when the plates are randomly placed. Each overlap region is a capacitance/conductance cell whose dimensions account for the multiplicative increase in the complex dielectric constant. The S factor can attain values of at least 300 for random ordering of the plates 71.

A composite material containing microwave susceptor materials is disclosed in European Patent Application No. 87301481.5, filed Feb. 20, 1987, the entirety of which is hereby incorporated by reference.

Figure 20:
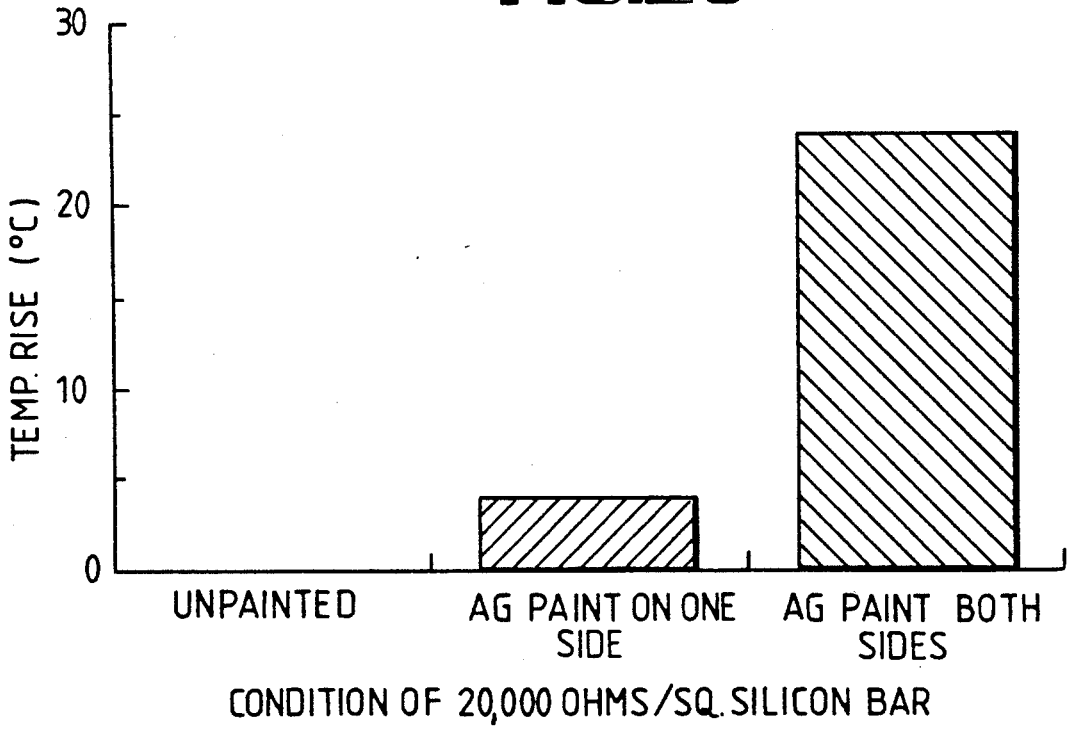
FIG. 20 is a bar graph showing the effect of conductive paint patches on heating of a silicon bar.

The additional microwave heating of a moderately lossy material caused by the addition of highly conductive plates in a staggered arrangement as discussed above is illustrated by an example performed on a silicon bar. The dielectric constant $\epsilon_4$ of the silicon bar was 13.7−j1.05 at room temperature. The same bar with the addition of the staggered conductive plates made of silver paint on two opposite sides had a dielectric constant of 501−j39.3 predicted by geometry and a measured dielectric constant of 574−j59.3. The bar with staggered plates corresponds to one layer of thickness $d_1$ shown in FIG. 18B. The significance of this increase in $\epsilon''_r$ is illustrated in FIG. 20 which shows the temperature rise of the silicon bar with staggered plates on two opposite sides, plates on one side only and with no plates. In each case the bar was heated in a microwave oven under the same conditions. The bar with plates on both sides experienced a temperature rise six times that of the same bar with plates on one side only. At the same oven power level, the temperature rise of the bar without plates was unobservable. The effect of highly conductive plates on one side only is thus intermediate between no plates and staggered plates on opposite sides. While the effect of plates on a single side of the microwave interactive layer is not so great as the effect of having plates in a staggered arrangement on either the opposite sides of or throughout the media, conductive plates on one side only are less difficult and expensive to make for thin film susceptors. The surface impedance of a layer of $Ti_2O_3$ may thus be lowered by the addition of a highly conductive layer of metal patches on one side. The surface impedance of the same $Ti_2O_3$ layer would be lowered even further by the addition of staggered conductive plates to the second side of the $Ti_2O_3$ layer.

Measurement of Susceptor Characteristics As A Function of Temperature

Figure 10:
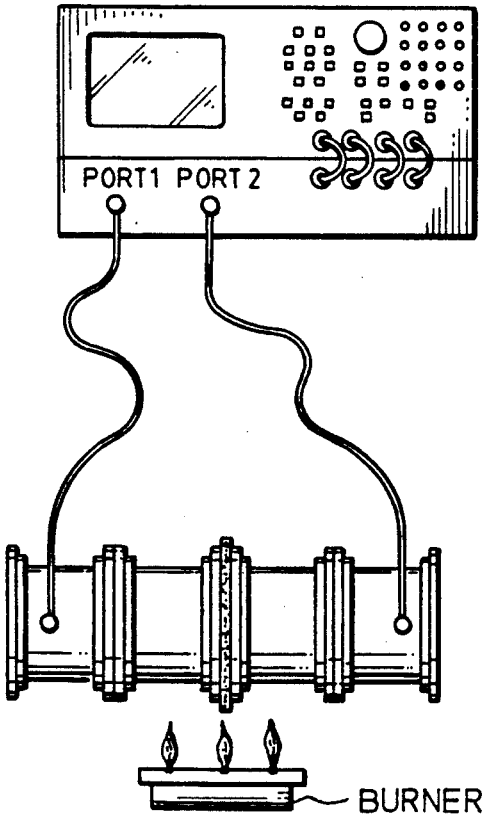
FIG. 10 is a schematic perspective view of a network analyzer test apparatus for testing the temperature response of susceptors.

The surface impedance and other susceptor characteristics were measured as a function of temperature using the apparatus diagrammed in FIG. 10. The susceptors were mounted in a section of WR 284 rectangular waveguide attached to a Hewlett-Packard Model 8753A network analyzer operating at 2.45 GHz, which measured susceptor S-parameters versus temperature as the waveguide was heated externally. S-parameters were converted to impedances as described in J. L. Altman, *Microwave Circuits* (1964), published by D. Van Nostrand Company, Inc., which is incorporated herein by reference. Reflected, absorbed and transmitted power can be calculated by considering the measured or calculated susceptor impedance as a shunt element connected across a matched transmission line fed by a matched generator as described in R. K. Moore, *Travelling Wave Engineering* (1960), published by McGraw Hill Book Company, Inc., which is incorporated herein by reference.

The apparatus shown in FIG. 10 measures the voltage reflection and transmission coefficients S11 and S21 respectfully associated with the susceptor mounted in the waveguide. The fraction of the power reflected and transmitted, R and T respectively, are the square of the magnitude of the corresponding voltage reflection and transmission coefficients. The fraction of the incident power absorbed by the susceptor is 1-R-T.

All the aforementioned coefficients and fractions depend on both the susceptor and the medium in which it is measured. The results of measurements made in one waveguide are easily converted to those in another size waveguide or in free space or other dielectric media by first computing the surface impedance in ohms/square from the formulas in Altman (appendix III, section 2) using the waveguide impedance. The resultant impedance may then be renormalized to the impedance of the media of interest and the various transmission and reflection coefficients as well as the absorption fraction recalculated.

Examples

Example 1

It is possible to make a susceptor in accordance with the present invention which reaches a maximum temperature that is limited because the susceptor's conductivity increases with increasing temperature. The temperature limiting characteristics of susceptors of this invention was demonstrated experimentally by observing the susceptor's steady state temperature during full power heating in a microwave oven. For purposes of comparison, a susceptor made from stainless steel deposited onto clear ⅛" thick neoceram glass, available commercially from Technical Glass in Kirkland, Wash., was heated in similar experiments. "Neoceram" is the trade name for a clear ceramic glass supplied by NEG (Nippon Electric Glass) of Japan. Stainless steel does not significantly change conductivity with increasing temperature. A Gerling microwave oven, available commercially from Gerling Laboratories, Modesto, Calif., was used. The oven was rated at 670 watts.

Since the steady state temperature of the susceptor depends on the rate of heat loss from the susceptor as well as absorbed power, and it was desired to measure absorbed power, factors which influence heat loss from the susceptor to the surroundings were carefully controlled. Accordingly, the susceptors were all cut to the same size (1.50"×3.00"). The susceptors were blackened in candle smoke so that their thermal emissivities would be similar. The air flow normally routed through the oven cavity was redirected to avoid forced convective cooling of the susceptors. Each sample was placed in the same location of the oven—a distance of 3⅛" from the oven floor. Steady state temperatures were measured during heating at full power using a Luxtron probe attached horizontally to the susceptor surface. For temperatures greater than 450° C., the failure point of the Luxtron probes, an infrared imaging camera was used which can measure temperatures up to 500° C.

A semiconductor susceptor made of germanium was used to show the effect upon steady state maximum temperatures where a susceptor has increasing conductivity with increased temperature. The germanium susceptor had a surface resistance of 500 ohms per square when measured at room temperature (25° C). The germanium susceptor was made from a wafer 0.015 inch thick. A stainless steel susceptor having a surface resistance of 500 ohms per square was not available, so tests were performed on available stainless steel susceptors having initial surface resistances of 391 ohms per square and 740 ohms per square, respectively.

The germanium susceptor reached a steady state temperature of 227° C. when exposed to microwave radiation. The stainless steel susceptors both reached a maximum temperature greater than 500° C.; (the stainless steel susceptors reached temperatures beyond the limits of what could be measured with available equipment).

A semiconductor susceptor made of silicon was also tested. The silicon susceptor had an initial surface resistance of 90 ohms per square when measured at room temperature (25° C.). The silicon susceptor was 0.015 inch thick. This silicon susceptor reached a steady state temperature of 400° C. For purposes of comparison, a stainless steel susceptor having an initial surface resistance of 86 ohms per square, when measured at room temperature (25° C.), was tested. The stainless steel susceptor reached a steady state temperature in excess of 500° C.

Since all thermal losses were comparable and carefully controlled, it is concluded that the lower steady state temperatures observed for the semiconductor susceptors (germanium and silicon) resulted from increased conductivity and consequent lower absorption at elevated temperature. The two temperature limiting semiconductor susceptors were made from materials which become more conductive at elevated temperature. The combination of thickness and conductivity for the semiconductor susceptors produced relatively low surface resistances and microwave absorbances at elevated cooking temperatures.

Example 2

Steak is difficult to cook in a microwave oven. Meat is highly susceptible to toughening if even slightly overheated. Disposable low mass conventional susceptors currently known to the art generally do not generate enough heat to properly sear the outside surfaces of a steak. Conventional susceptors become highly transmissive as a result of breakup and allow too much heating in the center and not enough at the surface of the steak. In this example, two semiconductor susceptors made of silicon were used to cook steak. The two susceptors 60 which were 7.62 centimeters in diameter and 0.038 centimeter thick, each with a surface resistance $R_s$ near 20 ohms per square. This relatively low surface resistance was found to be necessary for proper cooking of the steak. The perimeter of the steak was completely surrounded with a 1.90 centimeters band of aluminum foil 62. The assembly was refrigerated to about 4° C., and then placed on two 0.635 centimeter thick insulating pads centered on the shelf of a Litton Generation II microwave oven. After 2.5 minutes of microwave cooking, the steak was seared on both sides and still pink in the middle. The texture was assessed as easily chewable, tender and not tough.

Example 3

Figure 14:
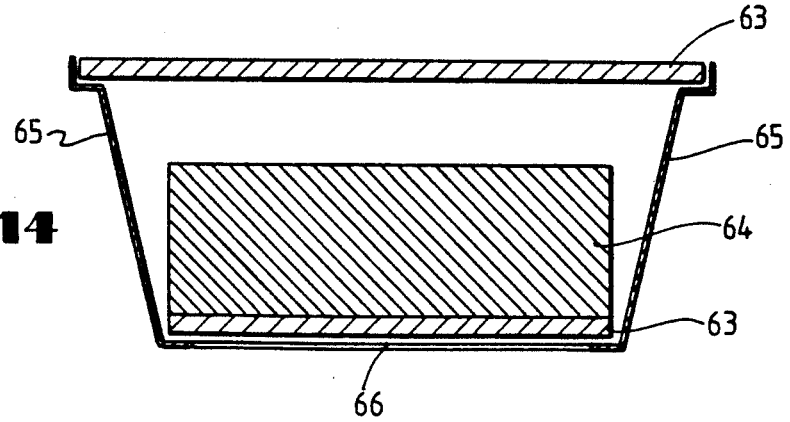
FIG. 14 is a schematic cross-sectional view of an arrangement where two susceptors constructed in accordance with the present invention were used to cook a biscuit.

FIG. 14 illustrates how susceptors of this invention may be used to cook a biscuit in a microwave oven. Baking biscuits in a microwave oven is a difficult task, requiring that several factors be properly balanced. The baking time must be long enough to provide opportunity for the biscuit to rise and establish a good cell structure. At the same time, the biscuit surface temperature should be high enough to brown and crispen the surface. When biscuit dough is heated by conventional microwave exposure, i.e., without benefit of the susceptors of this invention, the resulting cell structure is coarse and irregular. This is because steam is generated too rapidly for the biscuit structure to contain it. Under these conditions, the surface will also remain white and soggy. When conventional susceptors are used, they rapidly become microwave transmissive due to breakup, permitting excessively rapid microwave heating of the biscuit dough, while generally failing to provide sufficient heat to brown and crispen the surface.

In this example, a Pillsbury Ballard biscuit 64 was heated in a microwave oven using two silicon susceptors 63 with a surface resistance $R_s < 1$ ohm per square as shown in FIG. 14. One susceptor 63 was placed in the bottom of an aluminum foil cup 65 with a bottom outside diameter of about 5.08 centimeters and a top outside diameter of 7.62 centimeters. A hole 66 about 3.81 centimeters in diameter was cut in the bottom of the cup 65. The biscuit 64, 5.08 centimeters in diameter, was placed inside the cup 65 onto the bottom susceptor 63. The top susceptor 63, 7.62 centimeters in diameter, was placed in the flanged top of the aluminum cup 65. This assembly was placed on five 0.635 centimeter thick insulating pads (not shown) and cooked in a Litton Generation II microwave oven for 4.5 minutes. There was browning and crispening on both the top and bottom of the biscuit 64. When eaten, the texture was tender and not tough.

The above disclosure has been directed to a preferred embodiment of the present invention. The invention may be embodied in a number of alternative embodiments other than those illustrated and described above. A person skilled in the art will be able to conceive of a number of modifications to the above described embodiments after having the benefit of the above disclosure and having the benefit of the teachings herein. The full scope of the invention shall be determined by a proper interpretation of the claims, and shall not be unnecessarily limited to the specific embodiments described above.

What is claimed is:

1. A susceptor having a reflectance at a predetermined microwave frequency, comprising:

a microwave interactive heating layer which is operable to heat responsive to an electric field component of microwave radiation at the predetermined microwave frequency, the microwave interactive heating layer being operable to provide an increase in reflectance by a factor of at least three during heating from 23° C. to 250° C.

2. The susceptor according to claim 1, wherein:

the microwave interactive heating layer is formed on a substrate which has a transmittance greater than 80 percent when measured alone at the predetermined microwave frequency.

3. The susceptor according to claim 2, wherein:

the susceptor has a transmittance greater than 0.1 percent when the substrate and microwave interactive heating layer are measured together at 23° C. prior to heating.

4. A susceptor according to claim 3, wherein:

the microwave interactive heating layer comprises $TiO_x$, where x has a value between two and one.

5. A susceptor according to claim 2, wherein:

the microwave interactive heating layer comprises $TiO_x$, where x has a value between two and one.

6. A susceptor according to claim 1, wherein:

the microwave interactive heating layer is operable to provide an increase in reflectance by a factor of at least ten during heating from 23° C. to 250° C.

7. A susceptor according to claim 6, wherein:
the microwave interactive heating layer comprises $TiO_x$, where x has a value between two and one.

8. A susceptor according to claim 1, wherein:
the microwave interactive heating layer comprises $TiO_x$, where x has a value between two and one.

9. A susceptor according to claim 1, wherein:
the microwave interactive heating layer predominately comprises $Ti_2O_3$.

10. A susceptor for heating in a microwave oven, comprising:
a microwave interactive heating layer, the microwave interactive heating layer having a first surface resistance at 23° C., the microwave interactive heating layer having a second surface resistance at 250° C., the second surface resistance being at least three times less than the first surface resistance.

11. The susceptor according to claim 10, wherein:
the susceptor heats responsive to an electric component of microwave radiation.

12. The susceptor according to claim 10, wherein:
the second surface resistance is at least ten times less than the first surface resistance.

13. The susceptor according to claim 10, wherein:
the second surface resistance is at least 100 times less than the first surface resistance.

14. A susceptor for heating in a microwave oven, comprising:
a microwave interactive heating layer, the microwave interactive heating layer having a first electrical conductivity at 23° C., the microwave interactive heating layer having a second electrical conductivity at 250° C., the second electrical conductivity being at least three times more than the first electrical conductivity.

15. The susceptor according to claim 14, wherein:
the second electrical conductivity being at least ten times more than the first electrical conductivity.

16. A susceptor according to claim 15, wherein:
the microwave interactive heating layer predominately comprises $Ti_2O_3$.

17. A susceptor according to claim 15, wherein:
the microwave interactive heating layer predominately comprises a semiconductor material.

18. The susceptor according to claim 14, wherein:
the second electrical conductivity being at least 100 times more than the first electrical conductivity.

19. A susceptor according to claim 14, wherein:
the microwave interactive heating layer predominately comprises $Ti_2O_3$.

20. A susceptor according to claim 14, wherein:
the microwave interactive heating layer comprises a microwave interactive material loaded with a plurality of conductive plates.

21. A susceptor according to claim 20, wherein:
the conductive plates comprise thin flat plates randomly oriented in planes substantially parallel to the plane of the microwave interactive heating layer.

22. A temperature compensating thin film susceptor for heating a food item in a microwave oven, the susceptor having a reflectance at a predetermined microwave frequency, comprising:
a substrate; and,
a thin film microwave interactive heating layer deposited on the substrate, the microwave interactive heating layer being operable to heat responsive to an electric field component of microwave radiation at the predetermined microwave frequency, the microwave interactive heating layer being operable to provide an increase in reflectance by a factor of at least three during heating from 23° C. to 250° C.

23. The thin film susceptor according to claim 22, wherein:
the susceptor allows a portion of said microwave radiation at the predetermined microwave frequency to transmit through the susceptor to heat a food item directly.

24. The thin film susceptor according to claim 23, wherein:
the microwave interactive heating layer comprises $TiO_x$, where x has a value between two and one.

25. The thin film susceptor according to claim 23, wherein:
the microwave interactive heating layer predominately comprises $Ti_2O_3$.

* * * * *

UNITED STATES PATENT AND TRADEMARK OFFICE

CERTIFICATE OF CORRECTION

PATENT NO. : 5,019,681

DATED : May 28, 1991

INVENTOR(S) : Matthew W. Lorence et al

It is certified that error appears in the above-identified patent and that said Letters Patent is hereby corrected as shown below:

Column 4, line 23, "$LiNO_2$," should be -- $LiNO_3$, --; line 38, "$CrO_4$,e tc." should be -- $CrO_4$, etc. --; line 38, "$Li_2SO_4$,e tc." should be -- $Li_2SO_4$, etc. --.

Column 18, line 61, delete the word "is" after "$10^{18}$".

Column 19, line 25, "$68_0\epsilon_r$" should be -- $\epsilon_0\epsilon_r$ --; line 26, "$^j$farads" should be -- farads --; line 27, "$_k$is" should be -- is --; line 48, "$_k$is" should be -- is --.

Column 20, line 37, "$\epsilon_{41}$" should be -- $\epsilon_{r1}$ --.

Column 21, line 12, "$\epsilon_4$" should be -- $\epsilon_r$ --.

Signed and Sealed this

Twenty-second Day of September, 1992

*Attest:*

DOUGLAS B. COMER

*Attesting Officer*

*Acting Commissioner of Patents and Trademarks*